US007319443B2

(12) United States Patent
Kimura et al.

(10) Patent No.: US 7,319,443 B2
(45) Date of Patent: Jan. 15, 2008

(54) CURRENT SOURCE CIRCUIT, DISPLAY DEVICE USING THE SAME AND DRIVING METHOD THEREOF

(75) Inventors: Hajime Kimura, Kanagawa (JP); Kazutaka Inukai, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 477 days.

(21) Appl. No.: 10/650,080

(22) Filed: Aug. 28, 2003

(65) Prior Publication Data

US 2005/0190126 A1 Sep. 1, 2005

(30) Foreign Application Priority Data

Aug. 30, 2002 (JP) ..... 2002-256001

(51) Int. Cl.
*G09G 3/30* (2006.01)

(52) U.S. Cl. ..... 345/76; 345/82; 315/169.1

(58) Field of Classification Search ..... 345/76–83, 345/55, 204, 39; 315/169.1–169.4
See application file for complete search history.

(56) References Cited

U.S. PATENT DOCUMENTS 5,952,789 A * 9/1999 Stewart et al. ..... 315/169.4
6,229,506 B1 * 5/2001 Dawson et al. ..... 345/82
6,229,508 B1 5/2001 Kane
6,229,606 B1 5/2001 Way et al.
6,348,906 B1 2/2002 Dawson et al.
6,501,466 B1 12/2002 Yamagishi et al.
6,535,185 B2 3/2003 Kim
6,798,148 B2 9/2004 Inukai
7,138,967 B2 11/2006 Kimura
2003/0058195 A1 * 3/2003 Adachi et al. ..... 345/67
2003/0090447 A1 5/2003 Kimura
2003/0133243 A1 * 7/2003 Imamura ..... 361/115

(Continued)

FOREIGN PATENT DOCUMENTS

CN 1312535 9/2001

(Continued)

OTHER PUBLICATIONS

International Application No. PCT/JP03/11094 Search and Examination Report dated Oct. 28, 2003 (6 pages).

*Primary Examiner*—Richard Hjerpe
*Assistant Examiner*—Kimnhung Nguyen
(74) *Attorney, Agent, or Firm*—Fish & Richardson P.C.

(57) ABSTRACT

In a display device having a light emitting element, an accurate setting operation needs much time, unless a current value of the signal current (video signal) is set to high value. On the contrary, the driving current value for causing a light emitting element to emit light is very small. Therefore, it is difficult to perform an accurate setting operation. However, according to the present invention, the current source circuit includes plural transistors. The plural transistors are connected in parallel when the setting operation is performed on the current source circuit, whereas the plural transistors are connected in series when the light emitting element is caused to emit light. Further, the speed of the setting operation is increased because a light emitting element is capable of emitting light with a constant luminance and a current value to set up a current source circuit is higher than a driving current value when a light emitting element emits light.

28 Claims, 27 Drawing Sheets

U.S. PATENT DOCUMENTS

2003/0164685 A1 9/2003 Inukai

FOREIGN PATENT DOCUMENTS

| | | |
|---|---|---|
| EP | 0 905 673 A1 | 3/1999 |
| EP | 1 132 882 A3 | 6/2002 |
| EP | 1 341 148 A2 | 9/2003 |
| JP | 2001-147659 | 5/2001 |
| JP | 2003-066909 | 3/2003 |
| JP | 2003-255896 | 9/2003 |
| JP | 2003-263130 | 9/2003 |
| WO | WO 00/19476 | 4/2000 |

* cited by examiner

Setting Operation

Light Emission

Setting Operation

Light Emission

Setting Operation

Light Emission

Setting Operation

Light Emitting Element

Light Emission

Setting Operation

Light Emission

Setting Operation

Light Emission

Light Emission

CURRENT SOURCE CIRCUIT, DISPLAY DEVICE USING THE SAME AND DRIVING METHOD THEREOF

BACKGROUND OF THE INVENTION

1. Field of the Invention

The present invention relates to an active matrix type display device and driving method thereof in which a transistor and a light emitting element are provided in each pixel and a current source circuit can control light emission of a pixel by each transistor. More particularly, the present invention relates to an active matrix type EL display device using an electroluminescence element as a light emitting element.

2. Description of the Related Art

An active matrix EL display device having a transistor which control a light emitting element and light emission of the light emitting element has been gathering attention in recent years. Such display device has advantages of superiority in response, operation with a low voltage, a wide view angle and the like. Therefore, the active matrix display device has attracted attention as a next generation flat panel display.

Driving methods in the case where a multi-level gray scale image is displayed using a light emitting device provided with a light emitting element, are broadly divided into an analog gray scale method and a digital gray scale method. A difference between both the methods is a method of controlling the light emitting element in respective states of light emission and non-light emission of the light emitting element. The former analog gray scale method is a method of controlling the amount of current flowing into the light emitting element to obtain gray scale in analog form. The latter digital gray scale method is a method of driving the light emitting element with only two states of an ON state (state in which luminance is substantially 100%) and an OFF state (state in which luminance is substantially 0%).

The driving methods are broadly divided into a current input method and a voltage input method depending on the type of video signals (image signals) input to a pixel provided with a light emitting element. The current input method is a method performed by signal current, whereas the voltage input method is a method controlled by voltage.

Next, an example of a circuit structure of a pixel that adopts a current input method and a driving method thereof in a display device will briefly be explained with reference to FIG. 18. A pixel shown in FIG. 18 has a signal line 1801, first to third scanning lines 1802 to 1804, a power source line 1805, transistors 1806 to 1809, a capacitor element 1810, and a light emitting element 1811. A current source circuit 1812 is provided for the signal line.

A gate electrode of the transistor 1806 is connected to the first scanning line 1802. A first electrode of the transistor 1806 is connected to the signal line 1801 whereas a second electrode thereof is connected to a first electrode of the transistor 1807, a first electrode of the transistor 1808 and a first electrode of the transistor 1809. A gate electrode of the transistor 1807 is connected to the second scanning line 1803. A second electrode of the transistor 1807 is connected to a gate electrode of the transistor 1808. A second electrode of the transistor 1808 is connected to the power source line 1805. A gate electrode of the transistor 1809 is connected to the third scanning line 1804. A second electrode of the transistor 1809 is connected to one of electrodes of the light emitting element 1811. The capacitor element 1810 is connected between the gate electrode and the second electrode of the transistor 1808 to hold the gate-source voltage of the transistor 1808. The power source line 1805 and a cathode of the light emitting element 1811 receive predetermined electric potentials to hold an electric potential difference, respectively.

Operations from writing video signal to light emitting will be described below. First, pulses are inputted to the first scanning line 1802 and the second scanning line 1803 to turn the transistors 1806 and 18070N. Signal current (video signal) flowing in the signal line 1801 at this point is denoted by $I_{data}$ and the $I_{data}$ is supplied from the current source circuit 1812.

Accumulation of electric charges in the capacitor element 1810 continues until the electric potential difference between its two electrodes, namely, the gate-source voltage ($V_{GS}$) of the transistor 1808, reaches a desired voltage, that is, a voltage high enough to cause the current $I_{data}$ to flow into the transistor 1808. When the accumulation of electric charges is finished, the signal current $I_{data}$ continues to flow into the transistor 1808. A signal setting operation is conducted as above. Lastly, the selection of the first scanning line 1802 and the second scanning line 1803 is completed and the transistors 1806 and 1807 are turned to be OFF.

A light emission operation is described as follows. A pulse is inputted to the third scanning line 1804 to turn the transistor 1809 ON. With the transistor 1808 turned ON by $V_{GS}$ that is accumulated in the capacitor element 1810 in the preceding operation, current flows from the power source line 1805 to cause the light emitting element 1811 to emit light. Therefore, even if a characteristic of the transistor 1808 is unstable, the operation is not influenced.

Other pixel circuit structures that adopt current input method have been reported in U.S. Pat. No. 6,229,506 and Japanese Patent Laid Open No. 2001-147659.

In the structure of pixel circuit for current input method, a current value of signal current (video signal) written into a pixel and a driving current value when a light emitting element emits light need to be almost the same. However, an accurate setting operation needs much time, unless the current value of the signal current (video signal) is set to high value, because a parasitic capacitance (e.g., a capacitance at intersection of wirings) or resistance of wirings are generated in signal lines or the like provided in a pixel portion of a display device. On the contrary, the driving current value for causing a light emitting element to emit light is very small. Therefore, it is difficult to perform an accurate setting operation. Further, a variation in electric characteristic of the transistor 1808 is generated. This causes a fluctuation of current flowing to a light emitting element and a display unevenness.

Further, in displaying by analog gray scale method, it is required to write signal current having intensity corresponding to gray scale into each pixel every time a display is performed in each pixel. Thus, there is a necessity that electric charges corresponding to the signal current must be held again in a capacitor portion (a storage capacitor) of each pixel. It is difficult to perform an accurate setting operation when the signal current supplied to a pixel is small, that is, luminance is small. Further, an influence of a noise of a leak current or the like which occurs from a plurality of pixels connected to the same source signal line is tremendous, from other than the pixel in which writing of the signal current is carried out. On that account, there is such a high risk that it is impossible to cause the pixel to emit light with accurate luminance.

Accordingly, it is a distinct constraint that a current value of a video signal and a driving current value are the same value.

On the contrary, in controlling a transistor as a switch in digital form by a voltage input method (digital gray scale method), a constant voltage is applied to a light emitting element in a state of light emission. However, a relationship between a flowing current and a voltage applied to a light emitting element is changed due to a temperature in surrounding environment or deterioration of a light emitting element. Even if a constant voltage is applied to both electrodes of a light emitting element, a flowing current is actually changed. As a result, burning-in in a display or the like occurs.

SUMMARY OF THE INVENTION

It is an object of the present invention to provide a display device that can reduce influence on variation in transistors of pixels. Further, another object of the present invention is to provide a display device in which a light emitting element is to emit light with constant luminance, irrespective of changes in current characteristic caused by deterioration or the like.

In order to achieve the above objects, according to the present invention, each pixel in a display device has a current source circuit, a video control switch, and a light emitting element. ON/OFF of the video control switch is controlled by video signals. Thus, it is controlled whether current is supplied from the current source circuit to the light emitting element or not. As a result, gray scale can be expressed to display an image. The light emitting element, the current source circuit and the video control switch need to be connected in series between a power source reference line and a power source line. The connecting positions may be set as it is thought to be as necessary. $I_{data}$ is fed to the transistor connected to the light emitting element so that the current source circuit can output a constant amount of current. This is called setting operation. The current source circuit includes plural transistors. The plural transistors are connected in parallel when the setting operation is performed on the current source circuit. On the other hand, the plural transistors are connected in series when the light emitting element is caused to emit light.

The light emitting element is an electrooptic element changing the luminance based on the amount of the flowing current and, more specifically, an element including a light emitting layer between a first electrode and a second electrode.

In this way, by switching the connection states, the current value to be fed to the current source circuit can be increased. As a result, a setting operation can be performed more precisely in a shorter period of time.

A configuration of the present invention will be described specifically with reference to FIGS. 1A and 1B. A pixel shown in FIG. 1A has a signal line 101, a first scanning line 102, a power source line 103, a first switch 111, a second switch 112, a memory 113 connected to the first switch 111, a current source circuit 114 connected to the second switch 112, a light emitting element 115 connected to the second switch 112, and a power source reference line 116. The first switch 111 and the second switch 112 may be single or plural semiconductor elements having a switching function, such as transistors. The transistor having a switching function may be either of n-type or p-type.

ON/OFF of the first switch 111 is controlled by the first scanning line 102. Video signals from the signal line 101 are input to the memory 113 when the first switch 111 is turned ON, and the memory 113 holds the video signals. The second switch 112 is controlled based on the video signal. When the second switch 112 is turned ON, the signal current is supplied from the current source circuit 114 to a light emitting element.

FIG. 1B shows a structure of the current source circuit 114. The current source circuit 114 has a first switch 120, a second switch 121 and a driving element 122. The first switch 120 and the second switch 122 may be single or plural semiconductor elements having a switching function, such as transistors. The driving element 122 may be plural semiconductor elements, such as transistors. ON/OFF of the first switch 120 and second switch 122 is controlled by the second scanning line 123.

The ON/OFF control of the first switch 120 and second switch 121 by using signals from the second scanning line 123 can switch the parallel connection state and serial connection state of the plural transistors of the driving element 122. The transistors of the first switch 120 and second switch 121 may be either of n-type or p-type.

When a setting operation for signal current is performed, the transistors of the driving element 122 are connected in parallel. When the light emitting element is caused to emit light, the transistors of the driving element 122 are connected in series.

According to the present invention, a light emitting element can emit light at constant luminance irrespective of the changes in current characteristic due to deterioration, for example. Furthermore, according to the present invention, the current value for setting a current source circuit can be larger than driving current for causing a light emitting element to emit light. Therefore, the speed of the setting operation can be improved.

Since the current source circuit can output a constant amount of current, the influence of variation in transistors can be reduced. Video signals are different from current for setting the current source circuit. Therefore, video signals and current can be controlled independently. In other words, the current source circuit only feeds a constant amount of current, and video signals do not change the current value. Therefore, a setting operation can be performed at an arbitrary time and at arbitrary intervals.

As described above, according to the present invention, a display device can be provided which can express accurate gray scale and which can reduce uneven displays.

DESCRIPTION OF THE PREFERRED EMBODIMENTS

Figure 1A:
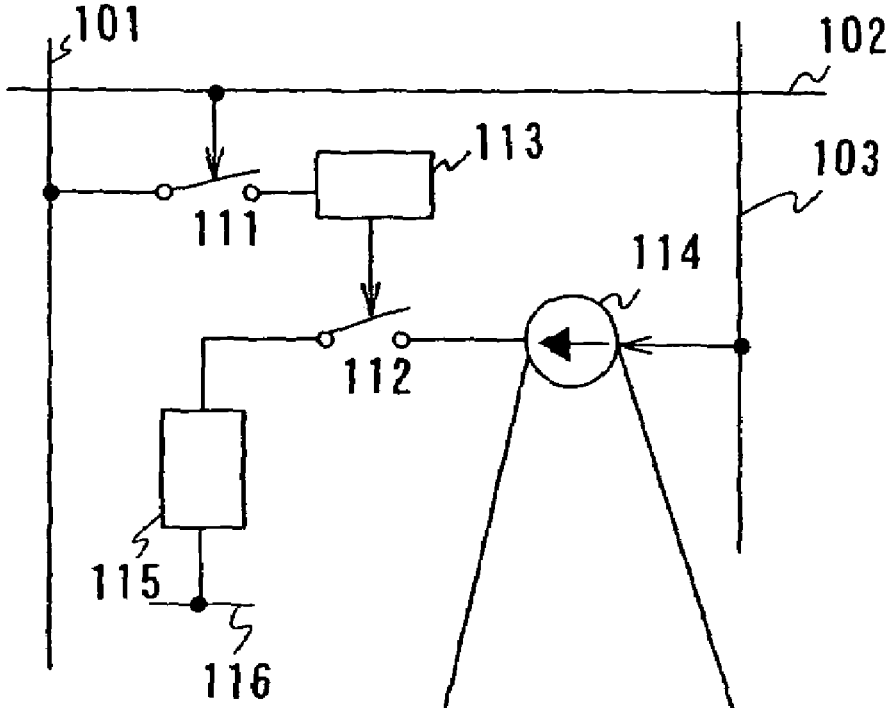
FIGS. 1A and 1B show a pixel according to the present invention.
Figure 1B:
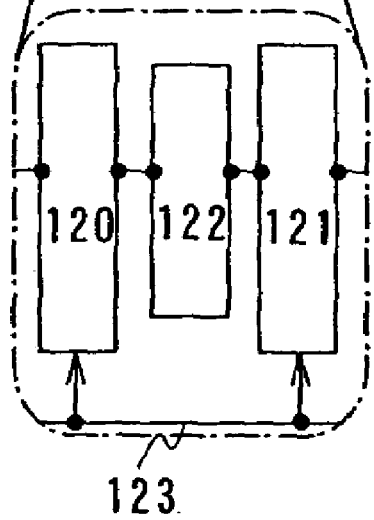

Embodiment Modes of the present invention will be described below with reference to the drawings. In the all drawings for describing the embodiment modes, the same reference numerals are given to the same components or functions, and the repeated description will be omitted.

According to the embodiment modes below, a transistor has three terminals including a gate, source and drain. Because of the structure of the transistor, the source electrode and drain electrode cannot be distinguished clearly. Therefore, in order to describe the connection between elements, one of the source electrode and the drain electrode is called first electrode and the other is called second electrode.

Embodiment Mode 1

A specific structure of a current source circuit according to Embodiment Mode 1 will be described.

Figure 22A:
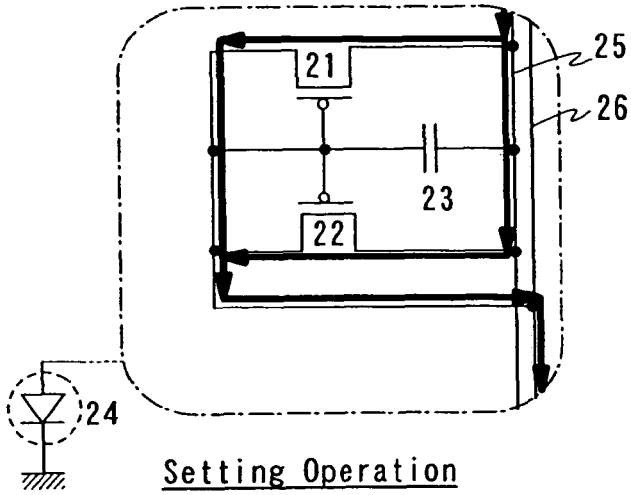
FIGS. 22A to 22C are circuit diagrams of a pixel according to the present invention.
Figure 22B:
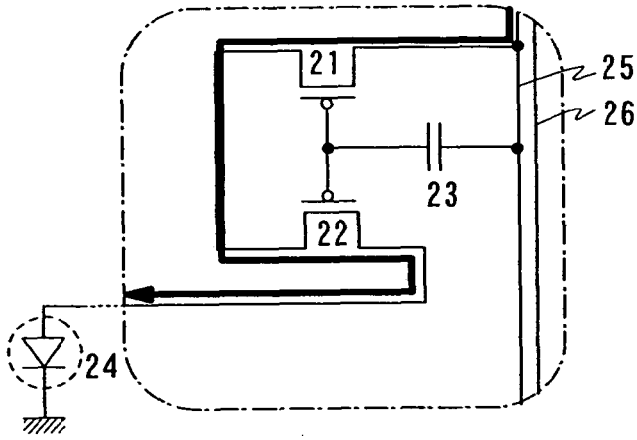
Figure 22C:
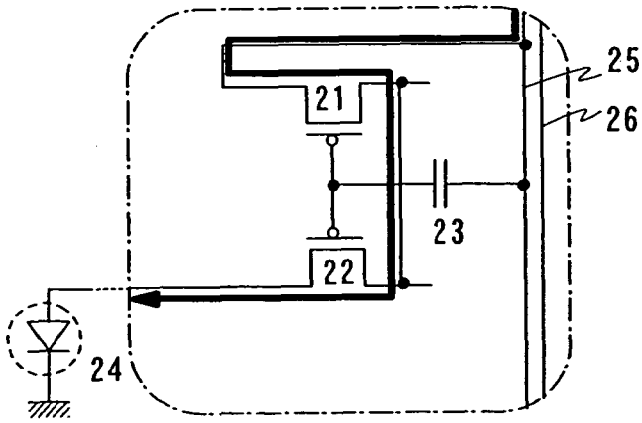

FIGS. 22A to 22C show a circuit structure where a driving element of the current source circuit has two transistors.

The current source circuit shown in FIGS. 22A to 22C has a first transistor 21, a second transistor 22, a capacitor element 23, a light emitting element 24, a current source line 25 and a power source line 26. The first transistor and second transistor have large gate capacitance and do not need capacitor elements when a leak current from each of the transistor falls in a permissible range. According to this embodiment mode, the first transistor and the second transistor are current source transistors, and the polarity is p-channel type.

FIG. 22A shows a current source circuit and a path that current flows during a setting operation. Each of FIGS. 22B and 22C shows a current source circuit and a path that current flows through during light emission. Since the connection is different between FIG. 23B and FIG. 23C, the direction that current flows is different. However, both of them are essentially the same.

According to the present invention, as shown in FIG. 22A, the first transistor 21 and the second transistor 22 are connected in parallel during a setting operation. On the other hand, as shown in FIGS. 22B and 22C, the first transistor 21 and the second transistor 22 are connected in series during light emission.

Since the connection state is switched between the setting operation and the light emission, switches are provided at some positions. According to this embodiment mode, the switches may be provided anywhere as far as current can flow as shown in FIGS. 22A, 22B and 22C during the setting operation and the light emission.

When a driving transistor may be provided in this embodiment mode, the driving transistor may be provided so as to meet requirements mentioned below during a setting operation and light emission. First of all, during a setting operation, current must flow as shown in FIG. 22A whether ON or OFF of the transistor (driving transistor) controlled by video signals. Furthermore, during light emission (when video signals are inputted), current must flow as shown in FIG. 22B or 22C while current must not flow as shown in FIG. 22B or 22C (the current path must be broken) when video signals are not inputted.

When a transistor for erasing may be provided in this embodiment mode, the current path may be arranged to break in order to shut off the light emitting element. The current path may be broken by the erasing transistor. Alternatively, the erasing transistor may be provided so as to turn off the driving transistor.

Figure 2A:
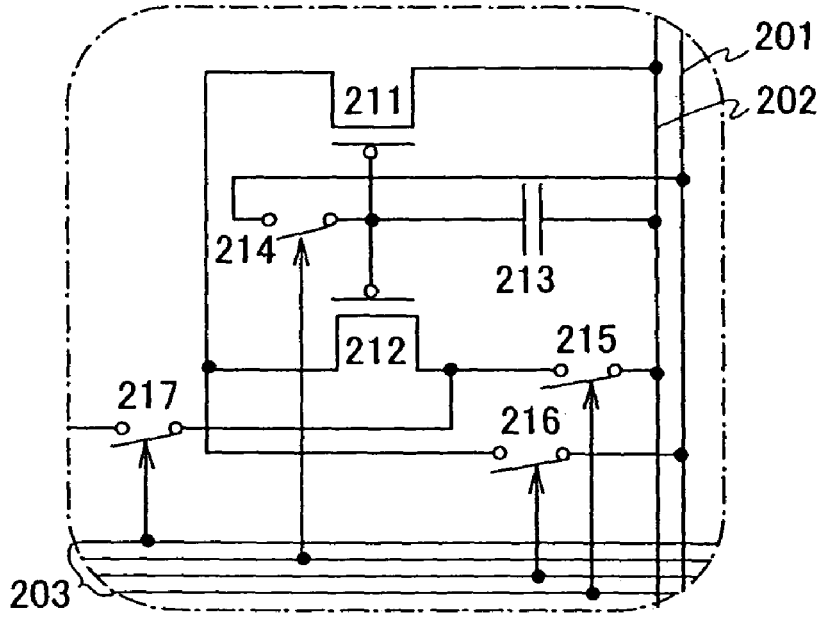
FIGS. 2A and 2B are circuit diagrams of a pixel according to the present invention.

FIG. 2A shows a specific current source circuit having switches. The current source circuit in FIG. 2A has a current source line 201, a current source line 202, a scanning line 203, a first transistor 211, a second transistor 212, a capacitor element 213, and first to fourth switches 214 to 217. The first to fourth switches 214 to 217 are controlled by the scanning line 203. Though the scanning line 203 is provided for each switch as shown in FIG. 2A, the scanning line may be shared by arranging the polarities of the transistors of the switches. Thus, the number of wirings can be reduced.

A connection relationship of the current source circuit in FIG. 2A will be described below. Here, the polarity of the first transistor 211 and the second transistor 212 each is p-channel type.

A gate electrode of the first transistor 211 and a gate electrode of the second transistor 212 are connected to each other constitute a current source transistor to function as a current source. The first switch 214 is connected to the current source line 201 and the power source line 202. Thus, the current supply to the capacitor element 213 provided between the gate electrodes of the first transistor 211 and the second transistor 212 and the power source line 202 can be controlled. A first electrode of the first transistor 211 is connected to the power source line 202. A second electrode thereof is connected to the current source line 201 through the third switch 216. A first electrode of the second transistor 212 is connected to the power source line 202 through the second switch 215. A second electrode thereof is connected to the second electrode of the first transistor 211. The fourth switch 217 is connected between the first electrode of the second transistor 212 and the light emitting element.

Figure 2B:
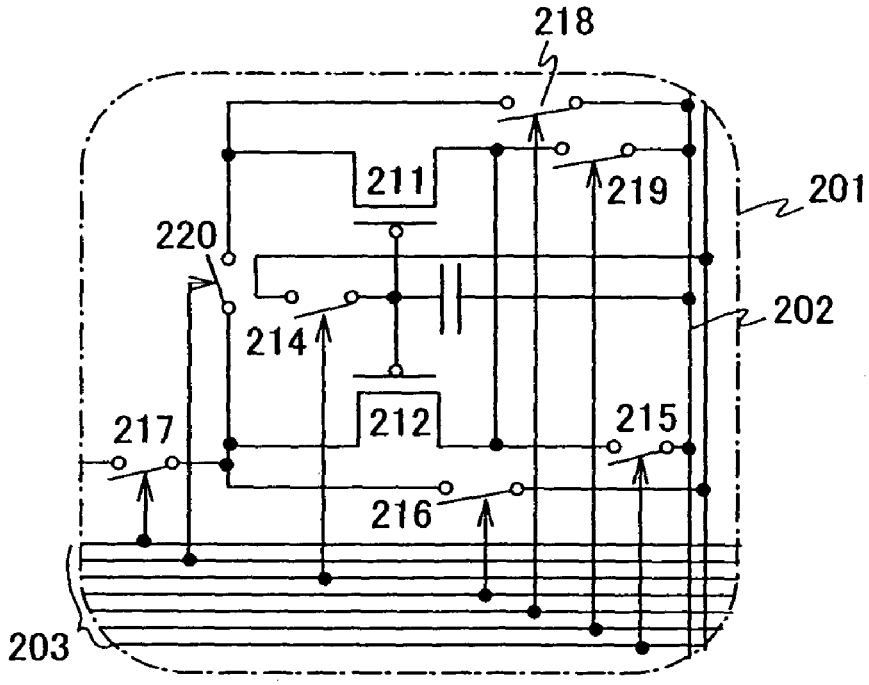

FIG. 2B shows a current source circuit different from the one shown in FIG. 2A. The current source circuit in FIG. 2B is different from the current source circuit in FIG. 2A in that the first electrode of the first transistor 211 and the first electrode of the second transistor 212 are connected to each other. Therefore, the current source circuit in FIG. 2B further includes fifth to seventh switches 218 to 220.

In other words, the current source circuit in FIG. 2B has the fifth to seventh switches 218 to 220 in addition to the current source line 201, the power source line 202, the scanning lines 203, the first transistor 211, the second transistor 212, the capacitor element 213 and the first to fourth switches 214 to 217. The first to seventh switches 214 to 217 are controlled by the scanning lines 203. Though the scanning line 203 is provided for each switch as shown in FIG. 2B, the scanning line may be shared by arranging the polarities of the transistors of the switches. Thus, the number of wirings can be reduced.

A connection relationship of the current source circuit in FIG. 2B will be described below with respect to the differences from that in FIG. 2A. Here, the polarity of the first transistor 211 and second transistor 212 each is p-channel type.

The fifth switch 218 is connected between the second electrode of the first transistor 211 and the power source line 202. The sixth switch 219 is connected between the first electrode of the first transistor 211 and the power source line 202. The seventh switch 220 is connected between the second electrode of the first transistor 211 and the second electrode of the second transistor 212. Unlike the current source circuit in FIG. 2A, the fourth switch 217 is provided between the second electrode of the second transistor 212 and the light emitting element.

Operations by the current source circuit in FIGS. 2A and 2B will be described with reference to FIGS. 3A to 4B.

Figure 3A:
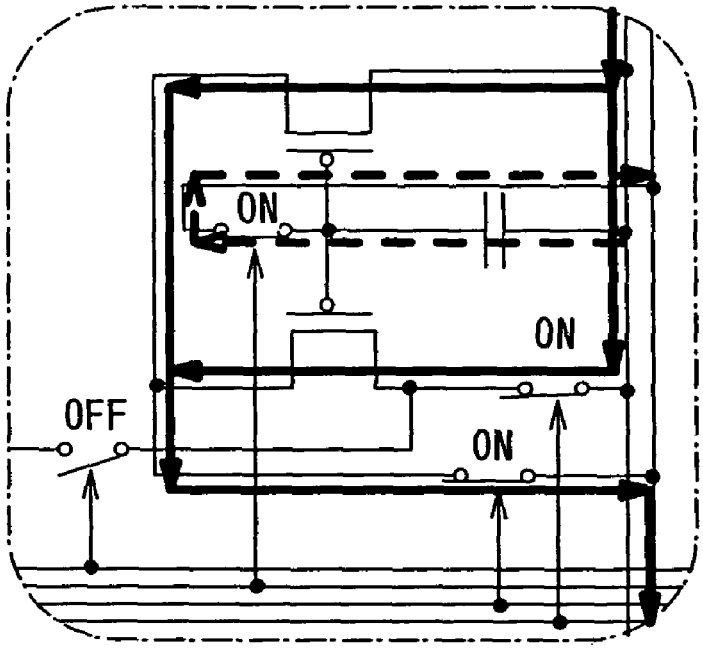
FIGS. 3A and 3B are circuit diagrams of a pixel according to the present invention.
Figure 3B:
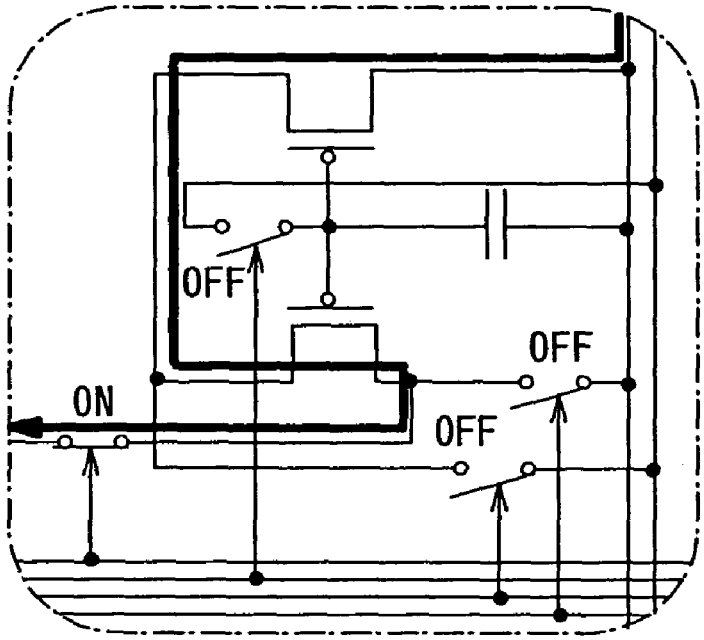

FIGS. 3A and 3B show states of transistors and switches during the setting operation (FIG. 3A) and the light emission (FIG. 3B) in the current source circuit in FIG. 2A. Broken and solid lines with arrows (called broken arrow and solid arrow, respectively, hereinafter) indicate current paths.

First of all, an operation during current setting will be described with reference to FIG. 3A. The polarity of the first transistor 211 and second transistor 212 is p-channel type.

The first switch 214, the second switch 215 and the third switch 216 are turned ON by the scanning lines 203, and the fourth switch 217 is turned OFF. As indicated by the broken line, current flows in order of the current source line 202→the capacitor element 213→the current source line 201, and electric charges are stored and are held in the capacitor element 213. The capacitor element 213 can supply a voltage based on the stored electric charges. When the voltage based on the stored electric charges exceeds a threshold value (Vth) of the first transistor 211 and second transistor 212, current is fed to the first transistor 211 and the second transistor 212, which are connected in parallel by the switches, as indicated by the solid arrow. In this case, the first transistor 211 and the second transistor 212 are set so as to supply a certain amount of signal current ($I_{data}$).

After that, light is emitted as shown in FIG. 3B (light emitting state). First of all, the scanning line 203 turns off the first switch 214, the second switch 215, and the third switch 216 and turns on the fourth switch 217. Then, current is fed to the first transistor 211 and the second transistor 212, which are connected in series, as indicated by the solid arrow, and signal current ($I_{data}$) is supplied to the light emitting element.

Figure 4A:
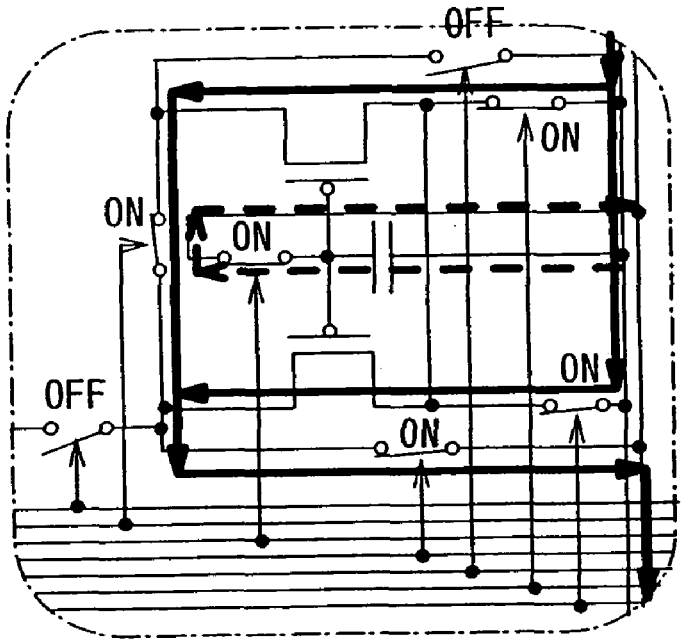
FIGS. 4A and 4B are circuit diagrams of a pixel according to the present invention.
Figure 4B:
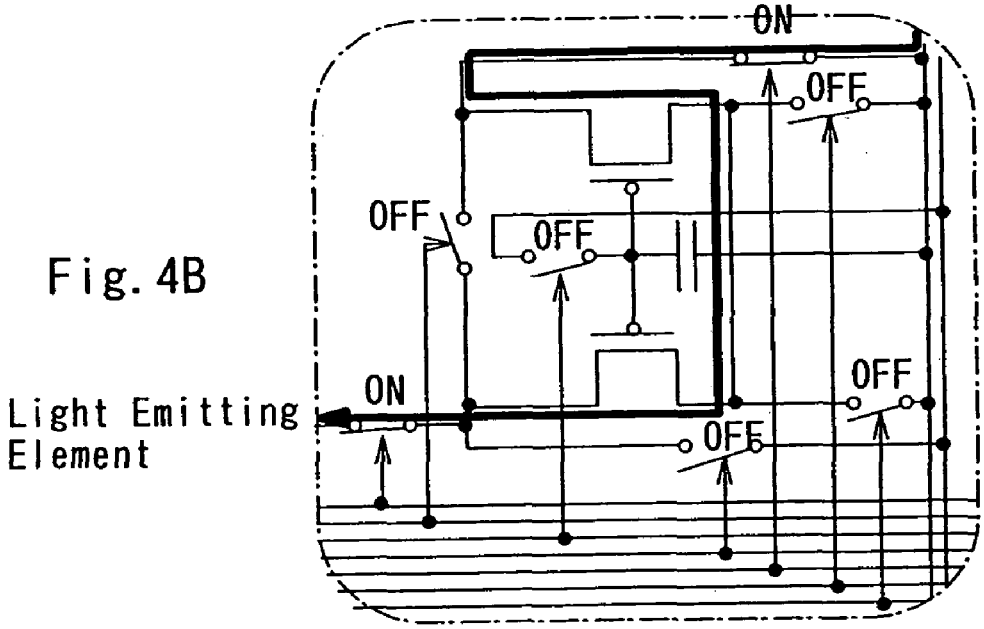

FIGS. 4A and 4B show states of the transistors and switches during the setting operation (FIG. 4A) and the light emission (FIG. 4B) in the current source circuit in FIG. 2B. The broken and solid arrows indicate current paths.

First of all, an operation during the current setting will be described with reference to FIG. 4A. Here, the polarity of the first transistor 211 and the second transistor 212 each is p-channel type.

FIG. 2B is different from FIG. 2A in that the first electrode of the first transistor 211 and the first electrode of the second transistor 212 are connected to each other that the fifth to seventh switches 218 to 220 are provided. Thus, during the setting in FIG. 4A, in addition to the setting operation in FIG. 3A, the scanning line 203 turns off the fifth switch 218 and turns on the sixth switch 219 and the seventh switch 220.

Like the state shown in FIG. 3A, a current flow in order of the current source line 202→the capacitor element 213→the current source line 201 as indicated by the broken line, and electric charges are stored and are held in the capacitor element 213. The capacitor element 213 can supply a voltage based on the stored electric charges. When the voltage based on the stored electric charges exceeds a threshold value (Vth) of each transistor, current is fed to the first transistor 211 and second transistor 212, which are connected in parallel, as indicated by the solid arrow. In this case, the first transistor 211 and second transistor 212 are set so as to supply a certain signal current ($I_{data}$).

After that, light is emitted as shown in FIG. 4B (light emitting state). In this case, in addition to the light emitting operation in FIG. 3B, the scanning line 203 turns on the fifth switch 218 and turns off the sixth switch 219 and the seventh switch 220. Then, current is fed to the first transistor 211 and the second transistor 212, which are connected in series, as indicated by the solid arrow and is supplied to the light emitting element.

In the current source circuit according to this embodiment mode, the connection relationship of the transistors and switches are not limited to those in FIGS. 2A and 2B and may be set as necessary so as to obtain a current path as shown in FIGS. 22A to 22C.

As described above, a unit (more specifically, switches controlled by scanning lines) can be used for connecting transistors in parallel during a setting operation and in series during light emission. Thus, even when current $I_E$ to be supplied to a light emitting element has a significantly small value, the setting operation can be performed securely in a short period of time.

When the first transistor 212 and the second transistor 212 have equal channel lengths (L) and channel widths (W) of the channel forming regions, and when the first transistor 211 and the second transistor 212 are connected in parallel, the width W and length L become double. Therefore, the current $I_E$ to be fed to the light emitting element and the current $I_{data}$ to be fed during the setting operation have a relationship expressed by $I_E = I_{data} \times (1/2) \times (1/2) = (1/4) \times I_{data}$.

Figure 23A:
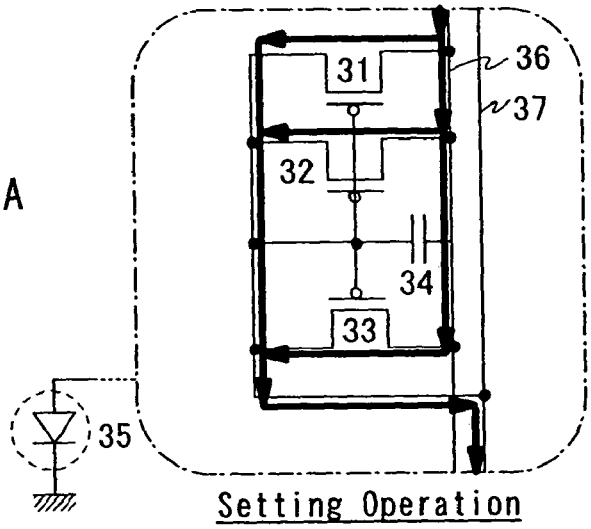
FIGS. 23A to 23C are circuit diagrams of a pixel according to the present invention.
Figure 23B:
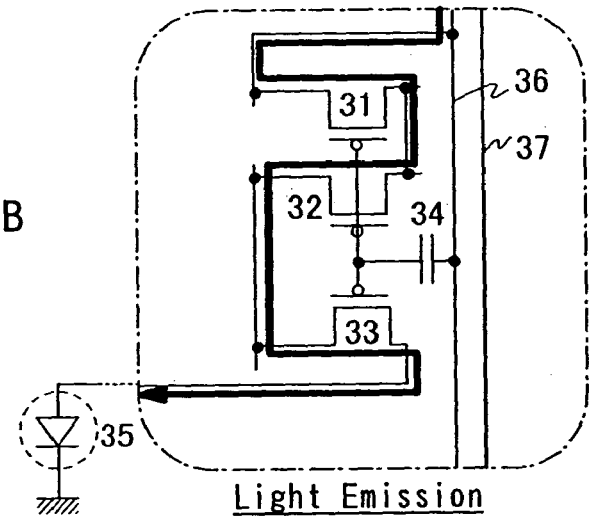
Figure 23C:
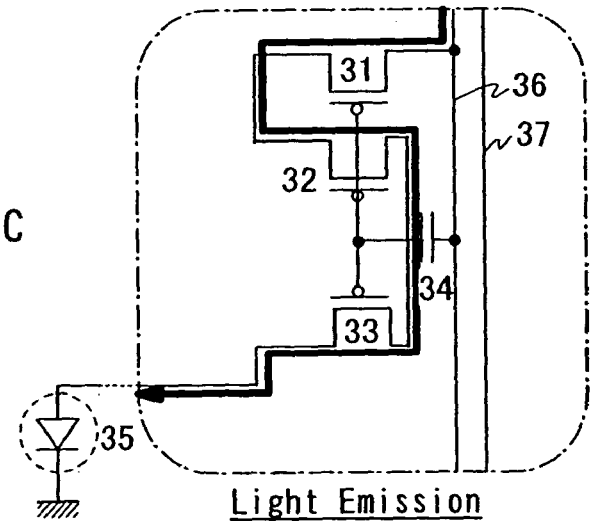

FIGS. 23A to 23C show a circuit structure where a driving element of a current source circuit has three transistors.

The current source circuit shown in FIGS. 23A to 23C has a first transistor 31, a second transistor 32, a third transistor 33, a capacitor element 34, a light emitting element 35, a current source line 36, and a power source line 37. The polarity of a first transistor 31, a second transistor 32 and a third transistor 33 each is p-channel type.

FIG. 23A shows a current source circuit and current paths during a setting operation. FIGS. 23B and 23C show a current source circuit and current paths during light emission. FIGS. 23B and 23C are different in that the direction of current flow and the connections are different. However, both of them are essentially the same.

According to the present invention, as shown in FIGS. 23A to 23C, the first transistor 31, the second transistor 32, and the third transistor 33 are connected in parallel during a setting operation while the first transistor 31, the second transistor 32 and the third transistor 33 are connected in series during light emission. Therefore, switches may be provided anywhere as far as current flows as shown in FIGS. 23A to 23C during the setting operation and the light emission.

When a driving transistor may be provided so as to meet requirements mentioned below during a setting operation and light emission. First of all, during a setting operation, current must flow as shown in FIG. 23A whether ON or OFF of the transistor (driving transistor) controlled by video signals. Furthermore, during light emission (when video signals are inputted), current must flow as shown in FIG. 23B or 23C while current must not flow as shown in FIG. 23B or 23C (the current path must be broken) when video signals are not inputted.

When an transistor for erasing is provided in this embodiment mode, the current path may be arranged to break in order to shut off the light emitting element. The current path may be broken by the transistor for erasing. Alternatively, the transistor for erasing may be provided so as to turn off the driving transistor.

Figure 5A:
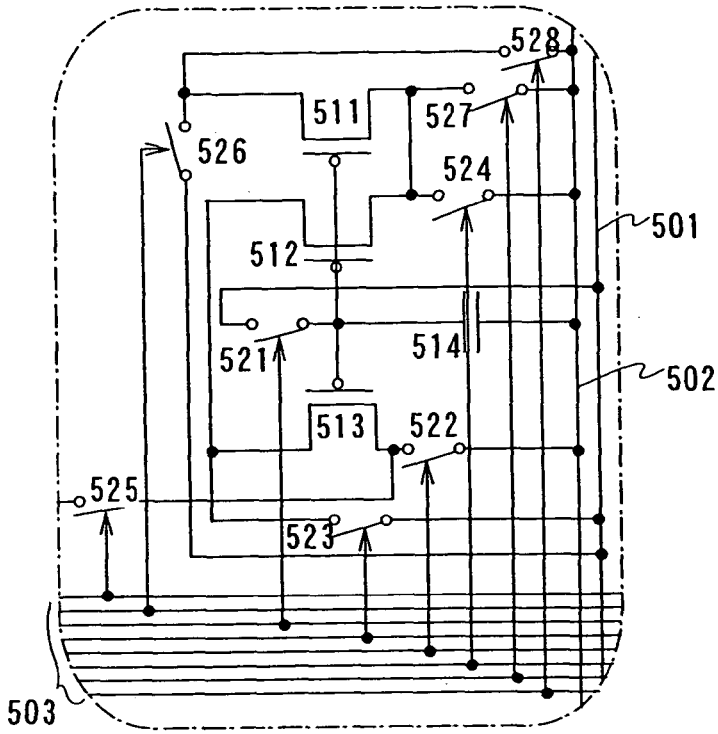
FIGS. 5A and 5B are circuit diagrams of a pixel according to the present invention.

FIG. 5A shows a specific current source circuit. The current source circuit in FIG. 5A has a current source line 501, a current source line 502, a scanning line 503, a first transistor 511, a second transistor 512, a third transistor 513, a capacitor element 514, and first to eighth switches 521 to 528. The first to eighth switches 521 to 528 are controlled by the scanning line 503. Though the scanning lines 503 is provided for each switch as shown in FIG. 5A, one scanning line may be shared by arranging the polarities of the transistors of the switches.

Next, a connection relationship of the current source circuit in FIG. 5A will be described below. Here, the polarity of the first transistor 511, the second transistor 512 and the third transistor 513 each is p-channel type.

A gate electrode of the first transistor 511, a gate electrode of the second transistor 512 and a gate electrode of the third transistor 513 are connected to each other constitute a current source transistor. The first switch 521 is connected to the current source line 501 and the power source line 502. Thus, the current supply to the capacitor element 514 between the gate electrodes of the first transistor 511, the second transistor and the third transistor 513 and the power source line 502 can be controlled. A first electrode of the first transistor 511 is connected to the power source line 502 through the seventh switch 527. A second electrode thereof is connected to the current source line 501 through the sixth switch 526. The second electrode of the first transistor 511 is connected to the power source line 502 through the eighth switch 528. A first electrode of the second transistor 512 is connected to the power source line 502 through the fourth switch 524. A second electrode thereof is connected to the second electrode of the third transistor 513 and is connected to the current source line 501 through the third switch 523. The first electrode of the first transistor 511 and the first electrode of the second transistor 512 are connected to each other. A first electrode of the third transistor 513 is connected to the power source line 502 through the second switch 522 and is connected to a light emitting element through the fifth switch 525.

Figure 5B:
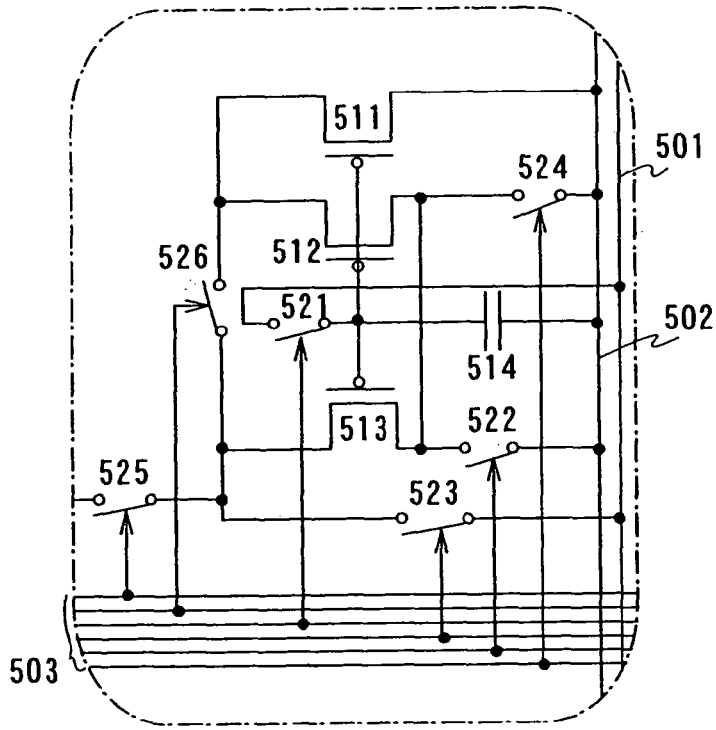

FIG. 5B shows a current source circuit different from the one shown in FIG. 5A. The current source circuit in FIG. 5B is different from the current source circuit in FIG. 5A in that the first electrode of the second transistor 512 and the first electrode of the third transistor 513 are connected to each other. Therefore, the number of switches and the number of wirings for switches are reduced, and the structure can be more simplified.

More specifically, the current source circuit in FIG. 5B has the current source line 501, the power source line 502, the scanning lines 503, the first transistor 511, the second transistor 512, the third transistor 513, the capacitor element 514 and the first to sixth switches 521 to 526. The first to sixth switches are controlled by the scanning lines 503.

A connection relationship of the current source circuit in FIG. 5B will be described below with respect to the differences from FIG. 5A. Here, the polarity of the first transistor 511, the second transistor 512 and the third transistor 513 each is p-channel type.

The first electrode of the first transistor 511 is connected to the power source line 502 through no switches. The second electrode of the first transistor 511 is connected to the second electrode of the second transistor 512 and is connected to the second electrode of the third transistor 513 through the sixth switch 526. Furthermore, the second electrode of the first transistor 511 is connected to the current source 501 through the third switch 523.

Next, operations by the current source circuit in FIGS. 5A and 5B will be described.

Figure 6A:
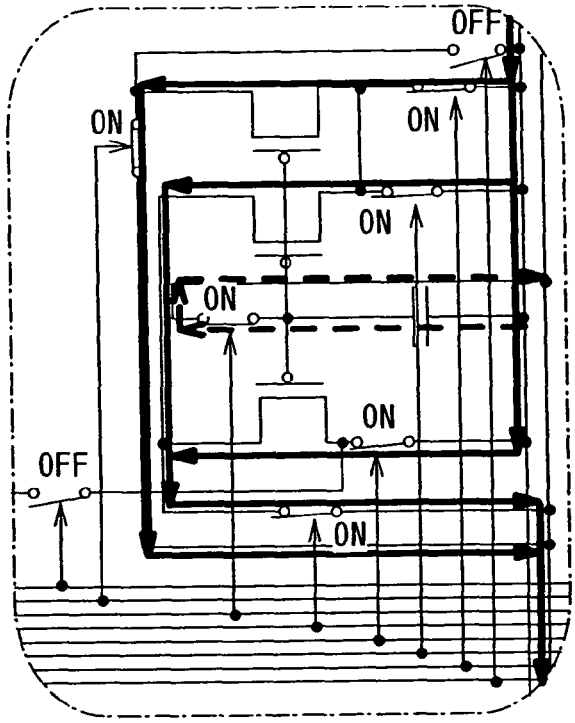
FIGS. 6A and 6B are circuit diagrams of a pixel according to the present invention.
Figure 6B:
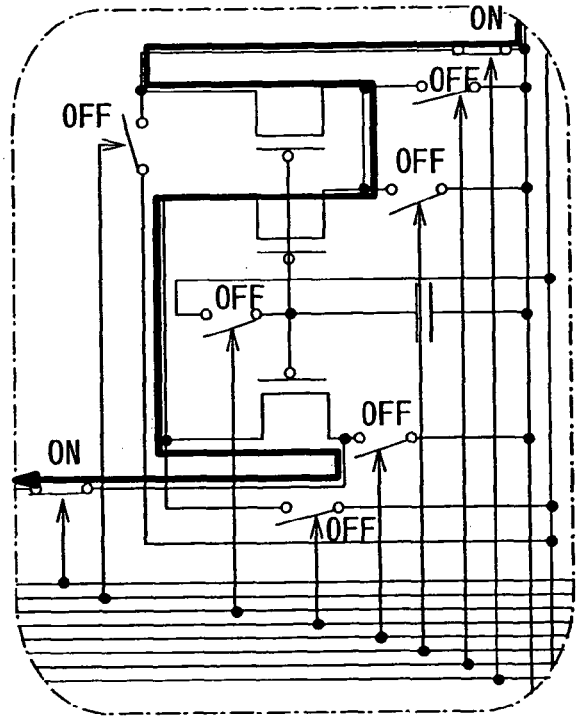

FIGS. 6A and 6B show states of transistors and switches during the setting operation (FIG. 6A) and the light emission (FIG. 6B) in the current source circuit in FIG. 5A. Broken and solid lines with arrows (called broken arrow and solid arrow, hereinafter) indicate current paths.

First of all, an operation during current setting will be described with reference to FIG. 6A. The polarity of the first transistor 511, the second transistor 512 and the third transistor 513 each is p-channel type.

The scanning lines 503 turns on the first switch 521, the second switch 522, the third switch 523, the fourth switch 524, the sixth switch 526 and the seventh switch 527 and turns off the fifth switch 525 and the eighth switch 528. As indicated by the broken line, current flows in order of the power source line 502→the capacitor element 514→the current source line 501, and electric charges are stored and are held in the capacitor element 514. The capacitor element 514 can supply voltage based on the stored electric charges. When the voltage based on the stored electric charges exceeds a threshold value (Vth) of the first transistor 511, the second transistor 512 and the third transistor 513, current flows to the first transistor 511, the second transistor 512 and the third transistor 513, which are connected in parallel by the switches, as indicated by the solid arrow. In this case, the first transistor 511, the second transistor 512 and the third transistor 513 are set so as to supply a certain amount of signal current ($I_{data}$).

After that, light is emitted as shown in FIG. 6B (light emitting state). First of all, the scanning lines 503 turn off the first switch 521, the second switch 522, the third switch 523, the fourth switch 524, the sixth switch 526 and the seventh switch 527 and turn on the fifth switch 525 and the eighth switch 528. Then, current is fed to the first transistor 511, the second transistor 512 and the third transistor 513, which are connected in series, as indicated by the solid arrow, and signal current ($I_{data}$) is supplied to the light emitting element.

Figure 7A:
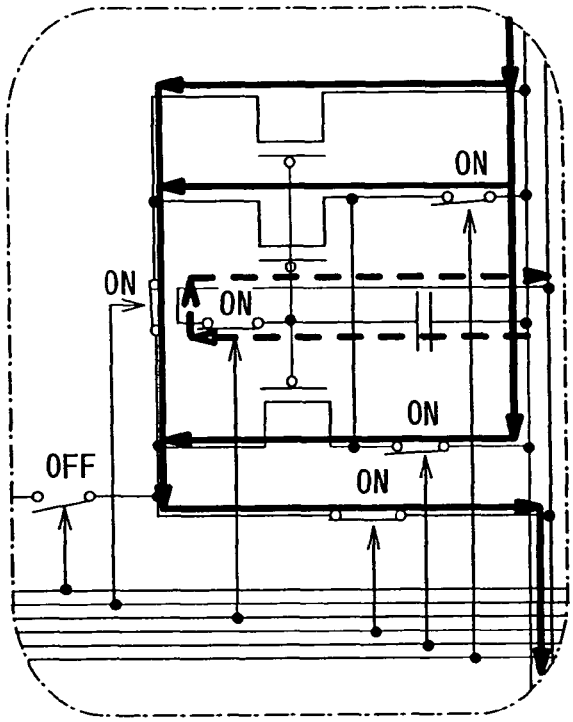
FIGS. 7A and 7B are circuit diagrams of a pixel according to the present invention.
Figure 7B:
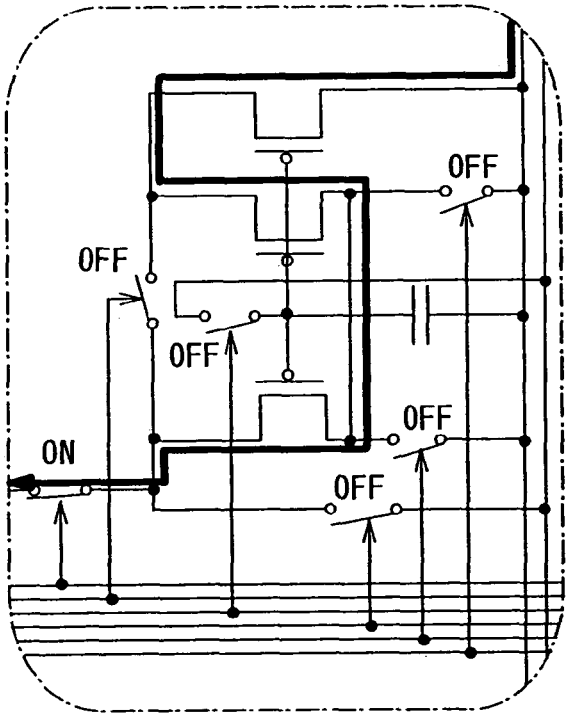

Next, FIGS. 7A and 7B show states of the transistors and switches during the setting operation (FIG. 7A) and the light emission (FIG. 7B) in the current source circuit in FIG. 5B. The broken and solid arrows indicate current paths.

First of all, an operation during the current setting will be described with reference to FIG. 7A. Here, the polarity of the first transistor 511, the second transistor 512 and the third transistor 513 each is p-channel type.

The scanning lines 503 turn on the first switch 511, the second switch 512, the third switch 513, the fourth switch 514, and the sixth switch 516 and turn off the fifth switch 515. Then, like the state shown in FIG. 6A, current flows as indicated by the broken line, and electric charges are stored and are held in the capacitor element 514. The capacitor element 514 can supply voltage based on the stored electric charges. When the voltage based on the stored electric charges exceeds a threshold value (Vth) of each transistor, current is fed to the first to the third transistors 511 to 513, which are connected in parallel, as indicated by the solid arrow. In this case, the first to the third transistors 511 to 513 are set so as to supply a certain signal current ($I_{data}$).

After that, light is emitted as shown in FIG. 7B (light emitting state). In this case, the scanning lines 503 turn off the first switch 521, the second switch 522, the third switch 523, the fourth switch 524 and the sixth switch 526 and turn on the fifth switch 525. Then, current is fed to the first to third transistors 511 to 513, which are connected in series, as indicated by the solid arrow and is supplied to the light emitting element.

In the current source circuit according to this embodiment mode, the connection relationships of the transistors and switches are not limited to those in FIGS. 5A and 5B and may be set as necessary so as to obtain a current path as shown in FIGS. 23A to 23C.

As described above, a unit (more specifically, switches controlled by scanning lines) can be used for connecting transistors in parallel during a setting operation and in series during light emission. Thus, even when current $I_E$ to be supplied to a light emitting element has a significantly small value, the setting operation can be performed securely in a short period of time.

When the first transistor 511, the second transistor 512 and the third transistor 513 have equal channel lengths (L) and channel widths (W) of the channel forming regions, and when the first transistor 511, the second transistor 512 and the third transistor 513 are connected in parallel, the width W and length L triple. Therefore, the current $I_E$ to be fed to the light emitting element and the current $I_{data}$ to be fed during the setting operation have a relationship expressed by $I_E=I_{data}\times(1/3)\times(1/3)=(1/9)\times I_{data}$.

For this embodiment mode, the cases have been described where two transistors and three transistors are provided as driving elements for a current source circuit. However, apparently, more transistors may be provided as necessary according to this embodiment mode.

As described above, transistors are arranged to connect in parallel during a current setting operation and to connect in series during light emission. In other words, a unit for causing transistors to be connected in parallel during a current setting operation and to be connected in series during light emission is provided.

Since set signal current is supplied to a light emitting element, a driving transistor can be used only as a switching element. Therefore, variations in intensity due to variations in electric characteristics of transistors can be reduced.

When transistors have the same electric characteristics, and when a current source transistor includes two transistors, the current value at the setting time is four times ($2^2$ times) of the current value to be supplied to a light emitting element. Generally, when n transistors are provided in a current source circuit, the current value $I_W$ at the setting time and the current value $I_E$ to be supplied to a light emitting element satisfy a relationship equation $I_W=n^2\times I_E$.

In order to satisfy the relationship equation, the transistors need to have the same electric characteristic. However, even when the electric characteristics of the transistors slightly vary, the relationship equation may be satisfied approximately in reality.

Therefore, in a current source circuit having plural transistors as a driving element, the connection of the plural transistors may be switched between parallel connection and serial connection in accordance with the current writing and the light emission by a light emitting element, respectively. Thus, the current value $I_W$ at the setting time and the current value $I_E$ supplied to a light emitting element during the light emission may be set arbitrarily. Therefore, even when $I_E$ is significantly small, the setting operation can be performed securely. Furthermore, the setting time can be reduced. In addition, variations in luminance of a light emitting element can be reduced.

Embodiment Mode 2

A specific pixel structure having a current source circuit for feeding current as shown in FIG. 22B during light emission according to a second embodiment will be described with reference to FIGS. 8A to 8C and FIG. 24.

Figure 8A:
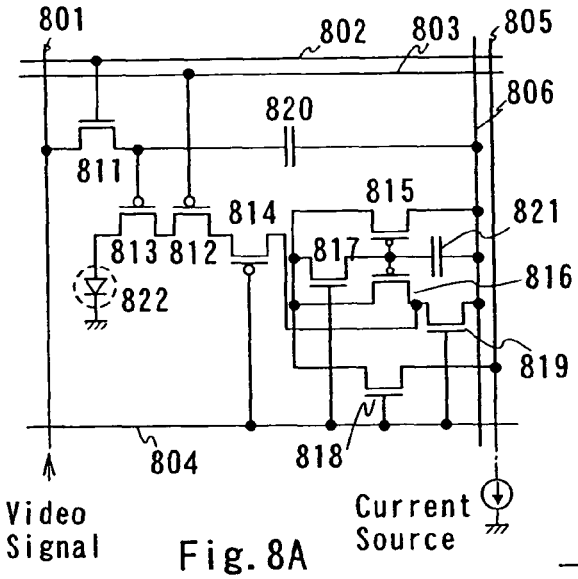
FIGS. 8A to 8C are circuit diagrams of a pixel according to the present invention.

FIG. 8A shows an example of a pixel including the current source circuit shown in FIGS. 22A to 22C. The pixel includes a signal line 801, a first scanning line 802, a second scanning line 803, a third scanning line 804, a current source line 805, a power source line 806, a first transistor 811 for selection, a second transistor 812 for erasing, a third transistor 813 for driving, a fourth transistor 814 for light emission, a fifth transistor 815 and sixth transistor 816 for current source, which are current source transistors, a seventh transistor 817 for holding, an eighth transistor 818 for current input, a ninth transistor 819 for switching, a first storage capacitor 820, a second storage capacitor 821 and a light emitting element 822.

According to this embodiment mode, the transistor for erasing may be provided arbitrarily and may be located anywhere as far as current is not fed to a light emitting element when the light emitting element needs to be shut off. For example, the second transistor 812 for erasing may be provided at a position for discharging electric charges in the capacitor element 820 or at a position for shutting off current to be supplied to the light emitting element 822 on a path that current flow. According to this embodiment mode, the current shut-off may be controlled by a transistor for erasing, or a transistor for erasing may be provided so that a driving transistor can control the current shut-off.

For the display in multi-level gray scale in Time Gray Scale Method in which one frame is divided by an arbitrary number, the second transistor 812 for erasing may be provided freely so as to provide an erasing time for stopping the light emission by a light emitting element at an arbitrary time. Then, when a period that the light emitting element is emitting light (light-up time) is longer than an address time, the erasing transistor is not required. Thus, a transistor for erasing may be provided optionally and may be also omitted in the pixels shown in FIGS. 8A to 8C and FIG. 24. The address time, the erasing time, the light-up time will be described in Embodiment Mode 6.

The fourth transistor 814 is not required when the second transistor 812 and/or the third transistor 813 are controlled to turn off in setting. Next, connection relationships among the components will be described.

A first electrode of the first transistor 811 is connected to the signal line 801, and a gate electrode of the first transistor 811 is connected to the first scanning line 802. A second electrode of the first transistor 811 is connected to a gate electrode of the third transistor 813 and is connected to the power source line 806 through the first storage capacitor 820. The first storage capacitor 820 can hold gate-source voltage of the first transistor 811. A gate electrode of the second transistor 812 is connected to the second scanning line 803, and a first electrode thereof is connected to a second electrode of the third transistor 813. A second electrode of the second transistor 812 is connected to a first electrode of the fourth transistor 814. A first electrode of the third transistor 813 is connected to the light emitting element 822. A gate electrode of the fourth transistor 814 is connected to the third scanning line 804, and a second electrode thereof is connected to a second electrode of the sixth transistor 816 and a first electrode of the ninth transistor 819. A gate electrode of the fifth transistor 815 and a gate electrode of the sixth transistor 816 are connected to each other to establish a current source transistor and are also connected to a first electrode of the seventh transistor 817. The second storage capacitor 821 is connected between the power source line 806 and the gate electrodes of the fifth transistor 815 and the sixth transistor 816. A first electrode of the fifth transistor 815 is connected to the power source line 806. A first electrode of the sixth transistor 816 is connected to the power source line 806 through the ninth transistor 819. A second electrode of the fifth transistor 815, a second electrode of the sixth transistor 816 and a second electrode of the seventh transistor 817 are connected to each other are further connected to the current source line 805 through the eighth transistor 818. The gate electrode of the fourth transistor 814, a gate electrode of the seventh transistor 817, a gate electrode of the eighth transistor 818, and a gate electrode of the ninth transistor 819 are connected to the third scanning line 804.

Figure 8B:
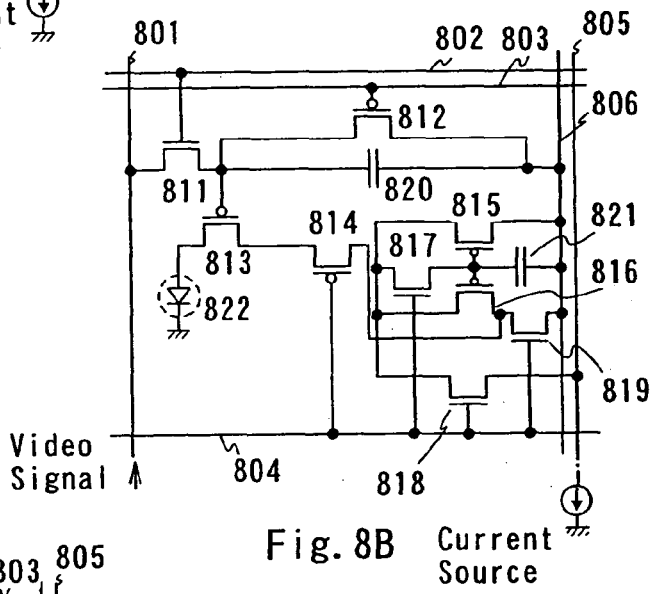
Figure 8C:
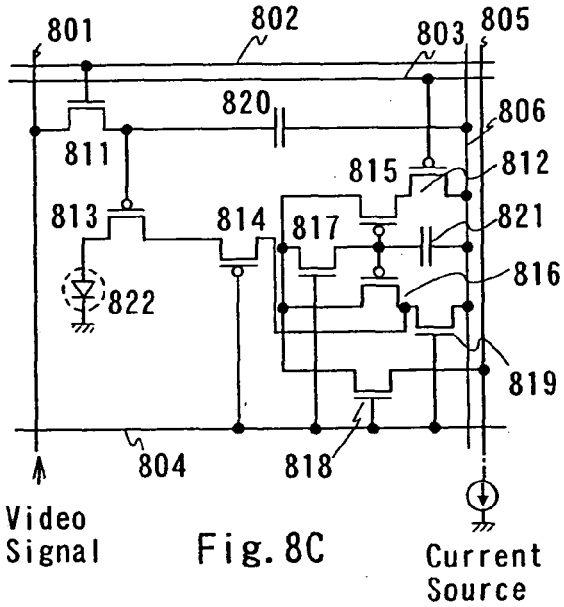

The position of the second transistor 812 for erasing is not limited to the position shown in FIG. 8A. For example, as shown in FIG. 8B, the second transistor 812 for erasing may be provided at a position for discharging electric charges in the capacitor element 820. Alternatively, as shown in FIG. 8C, the second transistor 812 for erasing may be provided on a path that current flow so as to shut off current to be supplied to the light emitting element 822.

In FIGS. 8A and 8B, when signal current is set in an erasing time, that is, when signal current is set in a period where the second transistor 812 and/or the third transistor 813 are turned off, the fourth transistor 814 can be omitted (removed).

Figure 24:
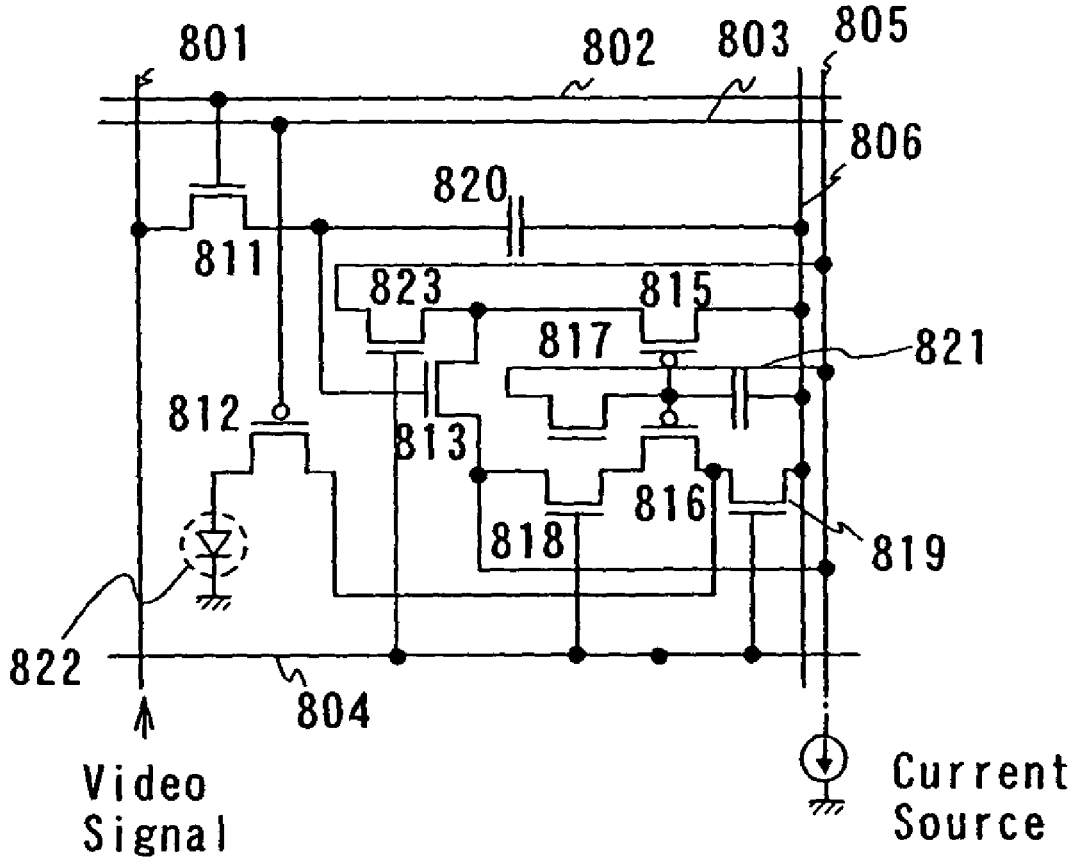
FIG. 24 is a circuit diagram of a pixel according to the present invention.

Furthermore, as shown in FIG. 24, the third transistor 813 for driving may be provided between the first electrode of the fifth transistor 815 and a first electrode of the eighth transistor 818. Then, a new transistor 823 may be provided between the third transistor 813 and the power source line 806.

Next, operations for setting current and for light emission will be described.

A display screen has plural pixels, which are shown in FIGS. 8A to 8C, and the first scanning lines 802 are sequentially selected. Then, the first transistor 811 connected to the selected first scanning line 802 is turned on, and a video signal is input from the signal line 801. Based on the input video signal, electric charges are stored in the first storage capacitor 820. When the amount of the stored electric charges exceeds Vgs of the third transistor 813, the third transistor 813 is turned on and can supply signal current to the light emitting element 822. Through this operation, images can be displayed.

In response to the state where signal current can be supplied to the light emitting element, the fourth transistor 814, for example, controlled by the third scanning line 804 is turned on. Then, signal current set by the current source circuit is supplied to the light emitting element 822. In other words, the first transistor 211 and the second transistor 212, which are connected in series as described in FIG. 2A and FIG. 3B, correspond to the fifth transistor 815 and the sixth transistor 816 in FIGS. 8A to 8C. Signal current is supplied to the light emitting element 822 through the fifth transistor 815 and the sixth transistor 816, which are connected in series.

In other words, the first switch 214, the second switch 215 and the third switch 216 in FIG. 2A correspond to the seventh transistor 817, the ninth transistor 819 and the eighth transistor 818 in FIGS. 8A to 8C, respectively.

The operation for setting signal current in the current source circuit is the same as the one described in FIG. 3A, and the description will be omitted here.

As described above, according to the present invention, a driving element of a current source circuit includes plural transistors. Thus, a unit (the transistors according to this embodiment mode) can be used for connecting transistors in parallel during a setting operation for writing current and in series during light emission for causing a light emitting element to emit light. Then, the current value $I_W$ during the setting operation and the current value $I_E$ of current to be supplied to a light emitting element during the light emission can be set arbitrarily. Thus, even when the current $I_E$ is significantly small, the setting operation can be performed securely. Furthermore, the setting time can be reduced. In addition, variations in luminance of the light emitting element can be reduced according to the present invention.

Embodiment Mode 3

In this embodiment mode, a specific example of a pixel provided with current source circuit in which current flows in emitting light as shown in FIG. 22C is given with reference to FIGS. 9, 10, 11A, 11B, 12, 13, and FIGS. 25 to 27. FIGS. 22B and 22C are different in that the direction of current flow and the connections are different. However, both of them are essentially the same.

Figure 9:
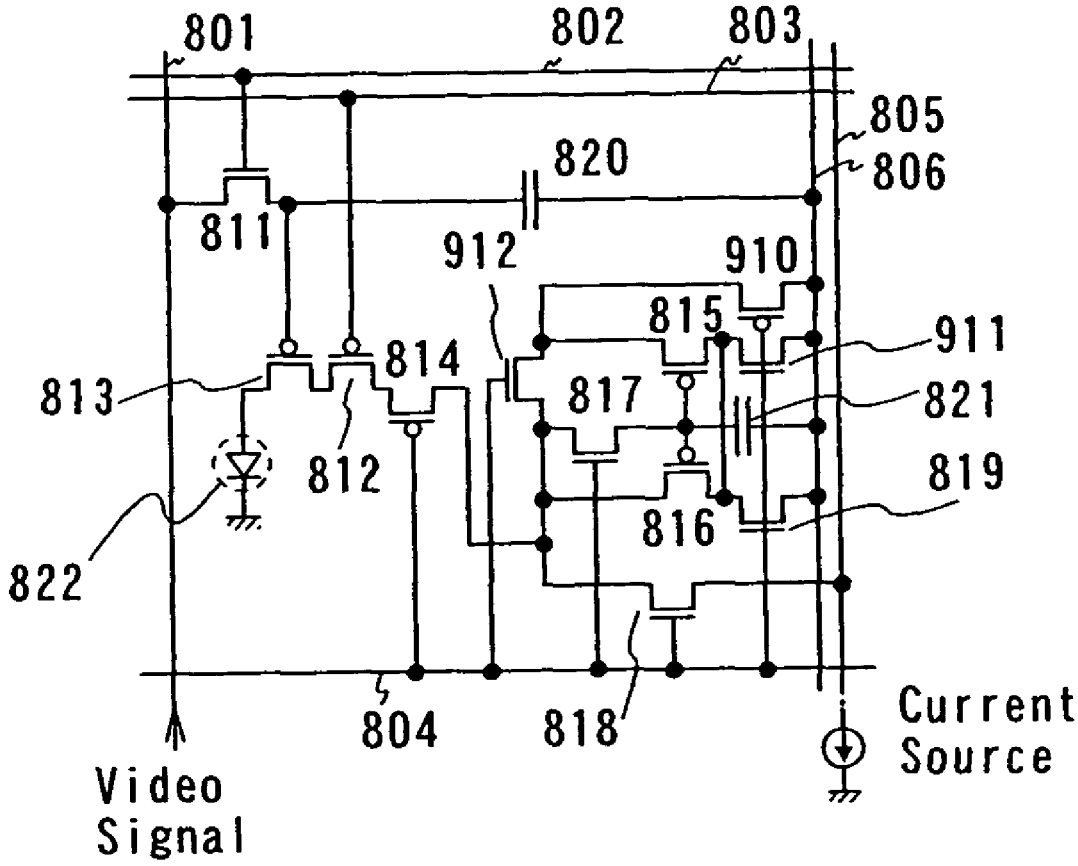
FIG. 9 is a circuit diagram of a pixel according to the present invention.

A pixel shown in FIG. 9 is an example for a pixel provided with a current source circuit in FIG. 22A to 22C. The second electrode of the fifth transistor 815 is connected to the second electrode of the sixth transistor 816. A tenth transistor 910 to a twelfth transistor 912 are provided and controlled by the third scanning line 804 in the pixel of FIG. 9.

The tenth transistor 910 is connected between the first electrode of the fifth transistor 815 that constitutes a current source transistor and the power source line 806. The eleventh transistor 911 is connected between the second electrode of the fifth transistor 815 and the power source line 806. The twelfth transistor 912 is connected between the first electrode of the fifth transistor 815 and the second electrode of the seventh transistor 817.

The pixel in FIG. 9 schematically shows the current source circuit shown in FIG. 2B. The fifth switch 218, the sixth switch 219 and the seventh switch 220 in FIG. 2B correspond to the tenth transistor 910, the eleventh transistor 911 and the twelfth transistor 912, respectively.

According to this embodiment mode, the erasing transistor may be provided arbitrarily and may be located anywhere as far as current does not flow to a light emitting element when the light emitting element needs to be shut off. For example, the second transistor 812 for erasing may be provided at a position for discharging electric charges in the capacitor element 820 or at a position for shutting off current to be supplied to the light emitting element 822 on a path that current flow. According to this embodiment mode, the current shut-off may be controlled by a transistor for erasing, or a transistor for erasing may be provided so that a driving transistor can control the current shut-off.

For the display in multi-level gray scale in Time Gray Scale Method in which one frame is divided by an arbitrary number, the second transistor 812 for erasing may be provided freely so as to provide an erasing time for stopping the light emission by a light emitting element at an arbitrary time. Then, when a period that the light emitting element is emitting light (light-up time) is longer than an address time, the erasing transistor is not required. Thus, a transistor for erasing may be provided optionally and may be also omitted in the pixels shown in FIGS. 8A to 8C and FIG. 24. The address time, the erasing time, the light-up time will be described in Embodiment Mode 6.

The fourth transistor 814 is not required when the second transistor 812 and/or the third transistor 813 are controlled to turn off in setting.

Then, the first transistor 811 connected to the selected first scanning line 802 is turned on, and a video signal is input from the signal line 801. Based on the input video signal, electric charges are stored in the first storage capacitor 820. When the amount of the stored electric charges exceeds Vgs of the third transistor 813, the third transistor 813 is turned on and can supply signal current to the light emitting element 822.

In response to the state where signal current can be supplied to the light emitting element, the fourth transistor 814 controlled by the third scanning line 804 is turned on. Then, signal current set by the current source circuit is supplied to the light emitting element 822. In other words, the first transistor 211 and the second transistor 212, which are connected in series as described in FIG. 4B, correspond to the fifth transistor 815 and the sixth transistor 816 in FIG. 9. Signal current is supplied to the light emitting element 822 through the fifth transistor 815 and the sixth transistor 816, which are connected in series.

The operation for setting signal current in the current source circuit is the same as the one described in FIG. 4A, and the description is omitted here.

Figure 10:
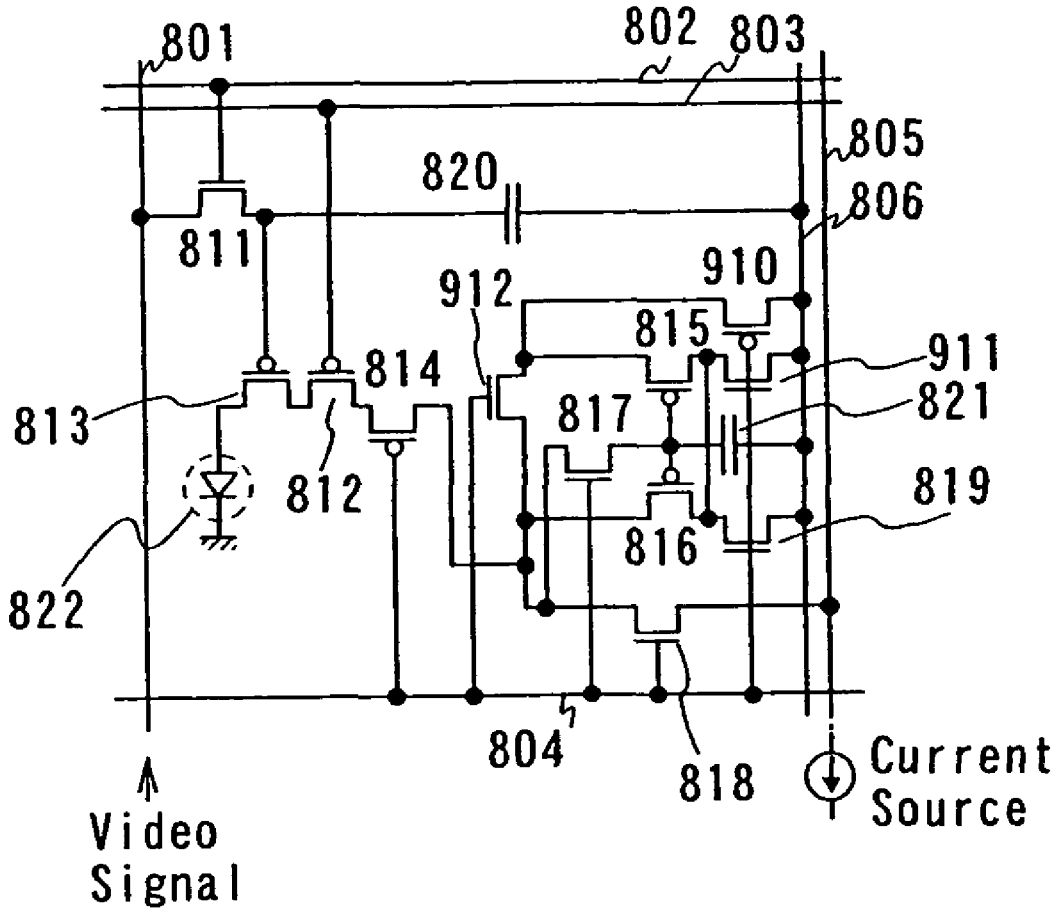
FIG. 10 is a circuit diagram of a pixel according to the present invention.

Next, a pixel shown in FIG. 10 is different from the pixel shown in FIG. 9 in that a first electrode of the seventh transistor 817 is directly connected to the first electrode of the eighth transistor 818.

The tenth transistor 910, the eleventh transistor 911 and the twelfth transistor 912 in FIG. 10 correspond to the fifth switch 218, the sixth switch 219 and the seventh switch 220 in FIG. 2B, respectively. The operation for setting or light emitting is the same as that of FIGS. 4A and 4B and thus, the description thereof is omitted.

In other words, the pixel shown in FIG. 10 can be applied to a pixel provided with the current source circuit shown in FIGS. 22A to 22C to obtain the similar effect.

Figure 11A:
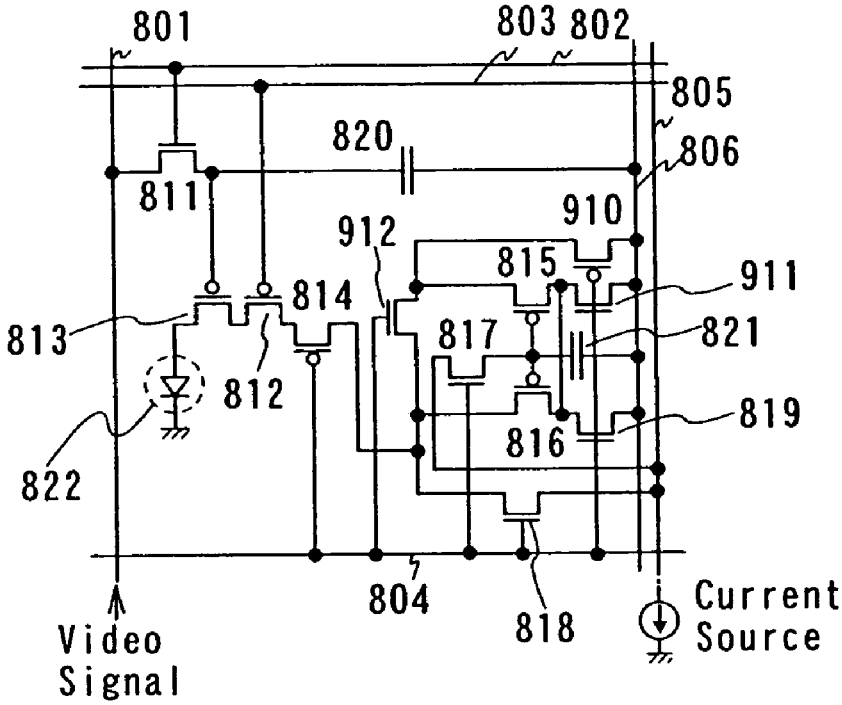
FIGS. 11A and 11B are circuit diagrams of a pixel according to the present invention.

Next, a pixel shown in FIG. 11A is different from the pixel shown in FIG. 10 in that the first electrode of the seventh transistor 817 is directly connected to the current source 805.

Figure 11B:
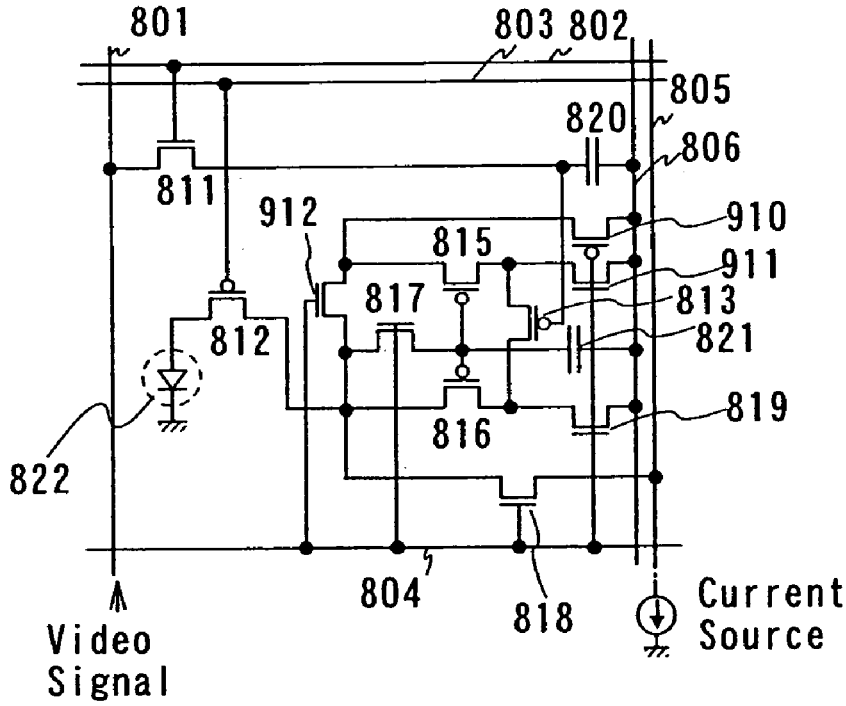

Also, as shown in FIG. 11B, the third transistor 813 for driving may be provided between the second electrode of the fifth transistor and the second electrode of the sixth transistor and the second transistor 812 for erasing may be provided in a position for preventing current from flowing to the light emitting element.

The tenth transistor 910, the eleventh transistor 911 and the twelfth transistor 912 in FIG. 11 correspond to the fifth switch 218, the sixth switch 219 and the seventh switch 220 in FIG. 2B, respectively. The operations for setting and light emitting is the same as that of FIGS. 4A and 4B and thus, the description thereof is omitted.

In other words, the pixel shown in FIG. 11 can be applied to a pixel provided with the current source circuit shown in FIGS. 22A to 22C to obtain the similar effect.

Figure 12:
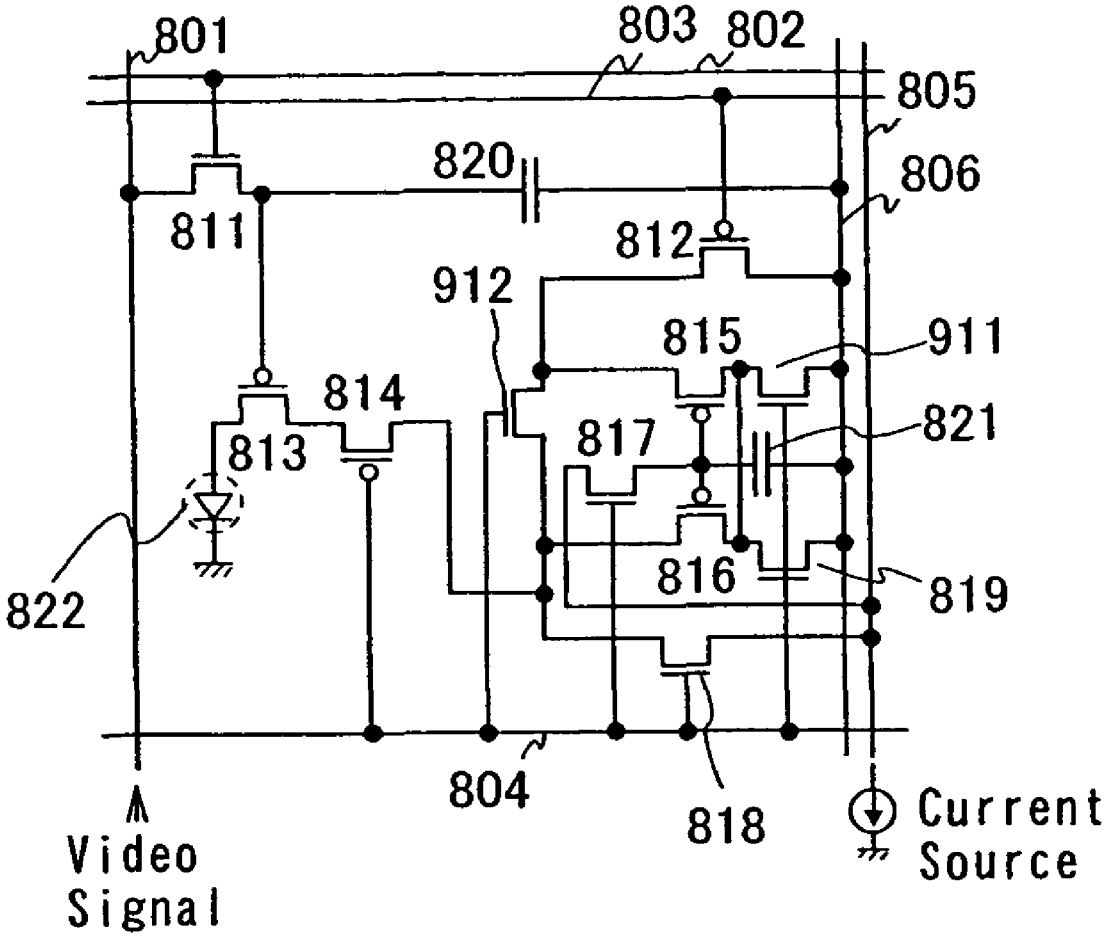
FIG. 12 is a circuit diagram of a pixel according to the present invention.

Next, a pixel shown in FIG. 12 is different from the pixel shown in FIG. 11 in that the second transistor 812 for erasing is directly connected between the power source line 806 and a first electrode of the tenth transistor 910.

In this way, the second transistor 812 for erasing is arranged in a position to block the current flowing to the light emitting element 822 appropriately. Also, the second transistor 812 for erasing may be arranged in a position to discharge charge electric charges of the first storage capacitor 820.

The tenth transistor 910, the eleventh transistor 911 and the twelfth transistor 912 in FIG. 12 correspond to the fifth switch 218, the sixth switch 219 and the seventh switch 220 in FIG. 2B, respectively. The operation for setting or light emitting is the same as that of FIGS. 4A and 4B and thus, the description thereof is omitted.

In other words, the pixel shown in FIG. 12 can be applied to a pixel provided with the current source circuit shown in FIG. 22 to obtain the similar effect.

Figure 13:
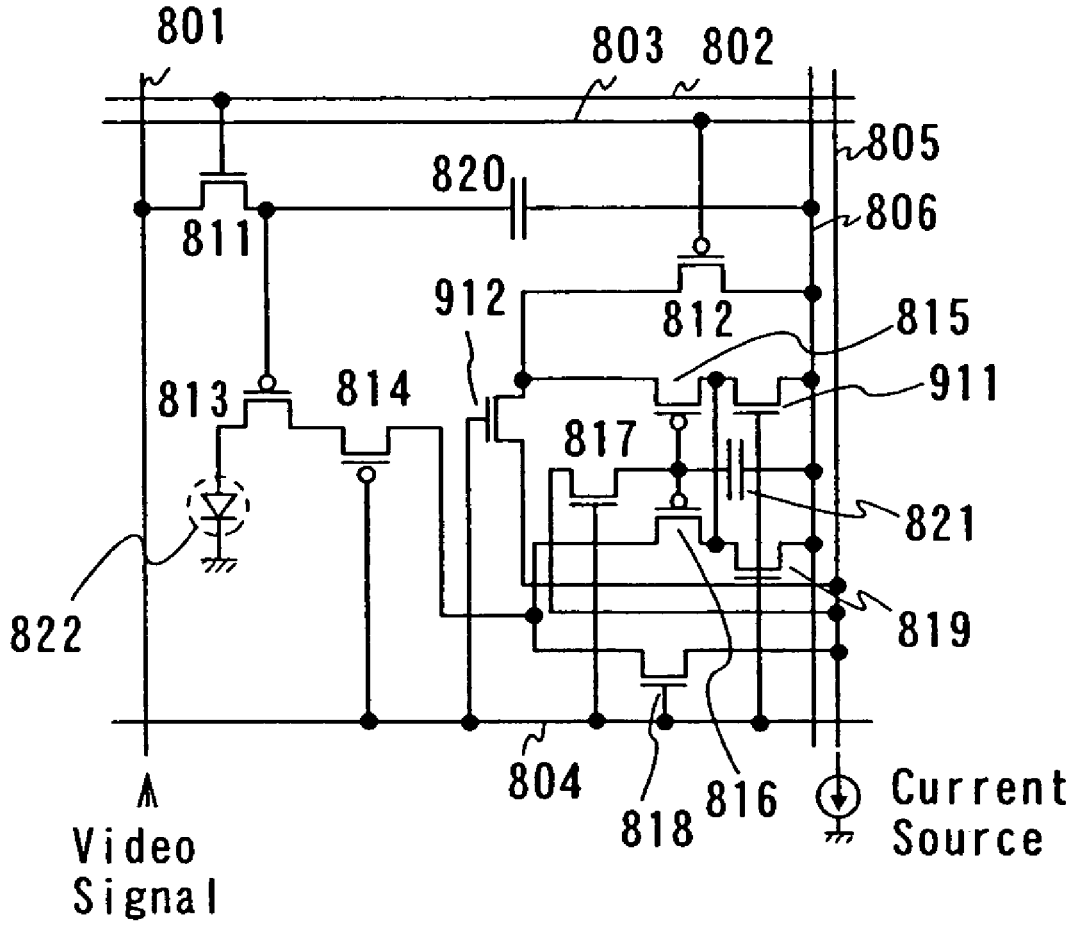
FIG. 13 is a circuit diagram of a pixel according to the present invention.

Next, a pixel shown in FIG. 13 is different from the pixel shown in FIG. 12 in that a first electrode of the eleventh transistor 912 is directly connected to the current source 805.

The tenth transistor 910, the eleventh transistor 911 and the twelfth transistor 912 in FIG. 13 correspond to the fifth switch 218, the sixth switch 219 and the seventh switch 220 in FIG. 2B, respectively. The operations for setting and light emitting is the same as that of FIGS. 4A and 4B and thus, the description thereof is omitted.

In other words, the pixel shown in FIG. 13 can be applied to a pixel provided with the current source circuit shown in FIG. 22 to obtain the similar effect.

Figure 25:
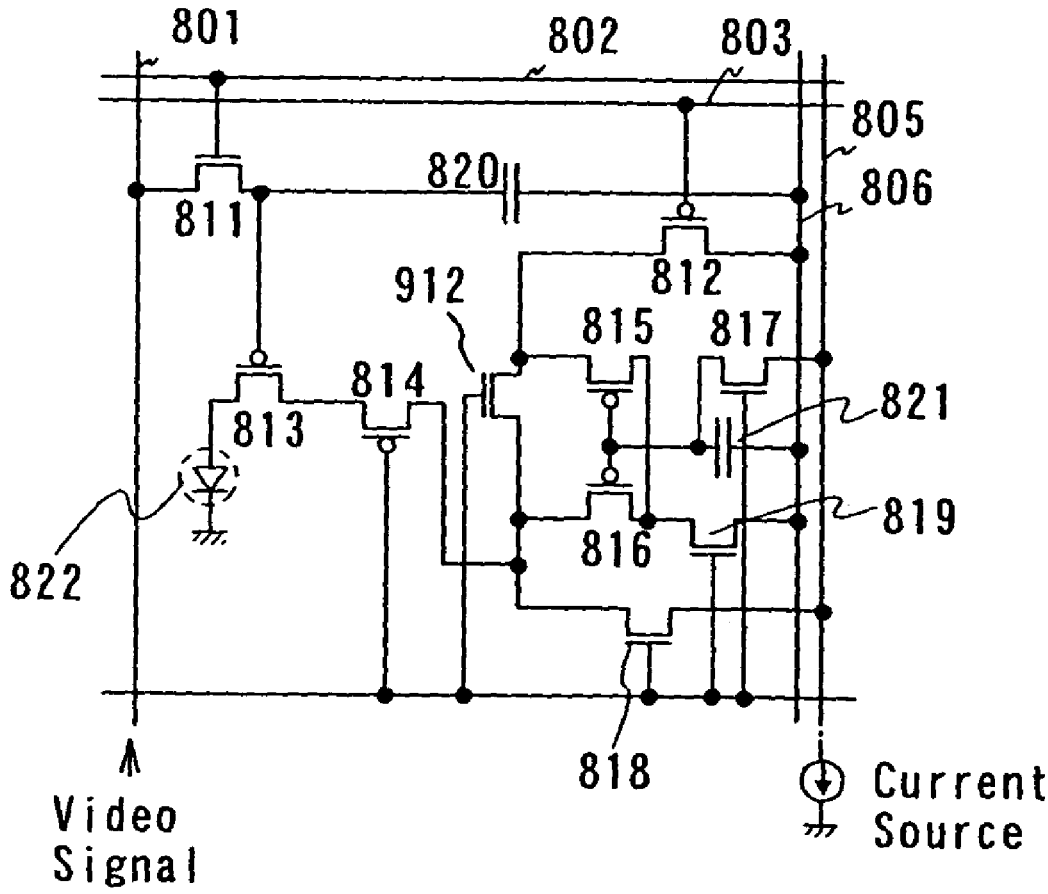
FIG. 25 is a circuit diagram of a pixel according to the present invention.

Further, as shown in FIG. 25, the second transistor 812 for erasing is provided between the fifth transistor 815 and the power source line 806, the seventh transistor 817 is provided between one of the second storage capacitor 821 and the power source line 806 to keep electric charges of the capacitor element and the second electrode of the fifth transistor 815 may be connected to the second electrode of the sixth transistor 816. At this time, the tenth transistor 910 and the eleventh transistor 911 can be omitted.

Figure 26:
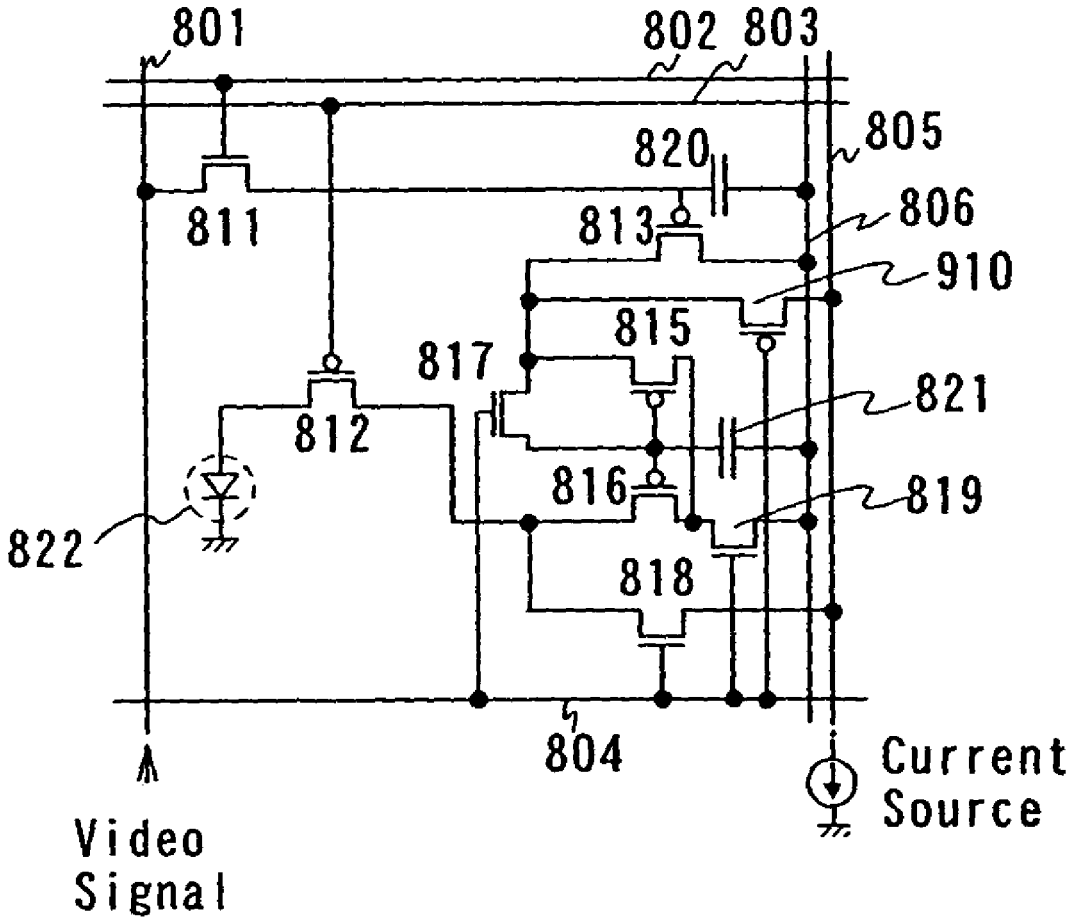
FIG. 26 is a circuit diagram of a pixel according to the present invention.

Also, as shown in FIG. 26, the third transistor 813 for driving may be provided between the tenth transistor 910 and the power source line 806. At this time, the fourth transistor 814, the eleventh transistor 911 and the twelfth transistor 912 can be omitted.

Figure 27:
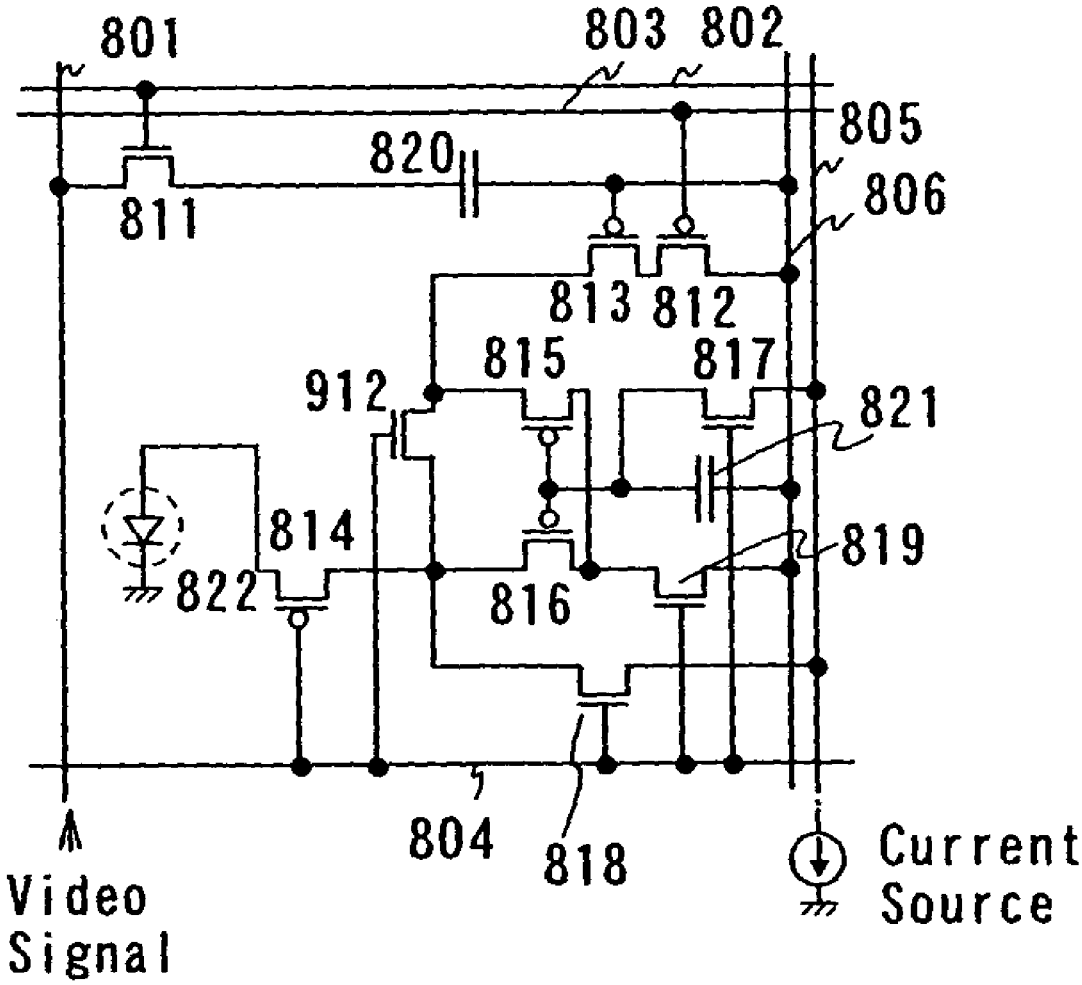
FIG. 27 is a circuit diagram of a pixel according to the present invention.

Further, as shown in FIG. 27, the second transistor 812 for erasing connected to the third transistor for driving is provided between the fifth transistor 815 and the power source line 806, the seventh transistor 817 is provided between one of the capacitor elements 821 and the current source line 805 to keep electric charges of the capacitor element and the second electrode of the fifth transistor 815 is connected to the second electrode of the sixth transistor 816. At this time, the tenth transistor 910 and the eleventh transistor 911 can be omitted.

In other words, the pixels shown in FIG. 25 to 27 can be applied to a pixel provided with the current source circuit shown in FIG. 22 to obtain the similar effect.

Embodiment Mode 4

In this embodiment mode, a specific pixel structure provided with current source circuit in which current flows as shown in FIG. 23B is described with reference to FIG. 14.

Figure 14:
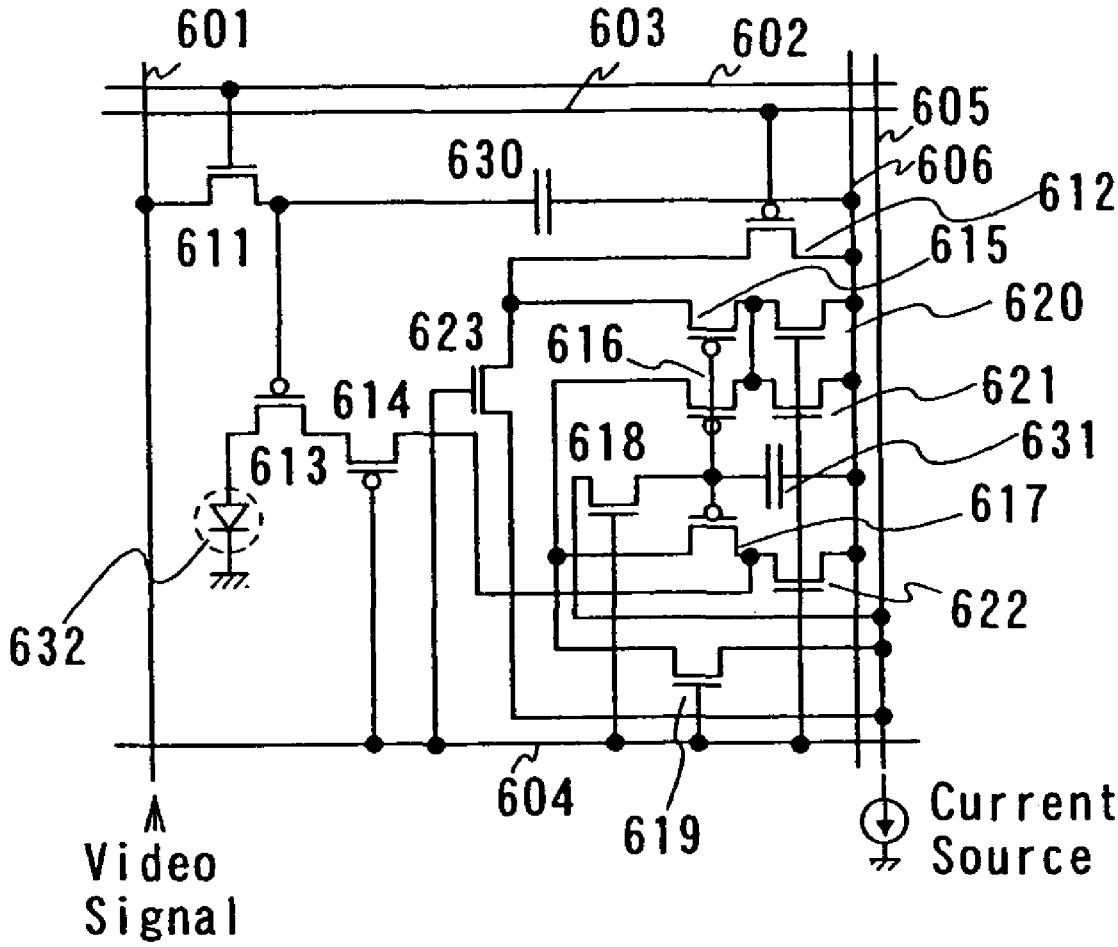
FIG. 14 is a circuit diagram of a pixel according to the present invention.

FIG. 14 shows an example of a pixel including the current source circuit shown in FIG. 23A to 23C. The pixel has a signal line 601, a first scanning line 602, a second scanning line 603, a third scanning line 604, a current source line 605, a power source line 606, a first transistor 611 for selection, a second transistor 612 for erasing, a third transistor 613 for driving, a fourth transistor 614 for light emission, a fifth to a seventh transistor 615, 616, 617 for current source, which comprise current source transistors, a eighth holding transistor 618, a ninth transistor 619 for current input, a switching tenth transistor 620 to a switching twelfth transistor 622, a thirteenth transistor 623 connected to the fifth transistor 615, a first holding capacitor 630, a second holding capacitor 631 and a light emitting element 632.

According to this embodiment mode, the erasing transistor may be provided arbitrarily and may be located anywhere as far as current does not to a light emitting element when the light emitting element needs to be shut off. For example, the second transistor 612 for erasing may be provided at a position for shutting off current to be supplied to the light emitting element 632 on a path that current flow instead of being provided at a position for discharging electric charges in the capacitor element 630 or. According to this embodiment mode, the current shut-off may be controlled by a transistor for erasing, or a transistor for erasing may be provided so that a driving transistor can control the current shut-off.

For the display in multi-level gray scale in Time Gray Scale Method in which one frame is divided by an arbitrary number, the second transistor 612 for erasing may be provided freely so as to provide an erasing time for stopping the light emission by a light emitting element at an arbitrary timing. Then, when a period that the light emitting element is emitting light (light-up time) is longer than an address time, the erasing transistor is not required. Thus, a transistor for erasing may be provided optionally. A transistor for erasing may be also omitted in some cases. The address time, the erasing time, the light-up time will be described in Embodiment Mode 6.

The fourth transistor 614 is not required when the second transistor 612 and/or the third transistor 613 are controlled to be in OFF state.

Next, connection relationships among the components will be described.

A first electrode of the first transistor 611 is connected to the signal line 601, and a gate electrode of the first transistor 611 is connected to the first scanning line 602. A second electrode of the first transistor 611 is connected to a gate electrode of the third transistor 613 and is connected to the power source line 606 through the first storage capacitor 630. The first storage capacitor 630 can hold gate-source voltage of the first transistor 611. A gate electrode of the second transistor 612 is connected to the second scanning line 603, and a second electrode thereof is connected to the power source line 606. A first electrode of the third transistor 613 is connected to the light emitting element 632. A gate electrode of the fourth transistor 614 is connected to the third scanning line 604, and a second electrode thereof is connected to the first electrode of the third transistor 613. Gate electrodes of the fifth transistor 615, the sixth transistor 616 and the seventh transistor 617 are connected to each other, comprise the current source transistor and are connected to a second electrode of the eighth transistor 618. The second storage capacitor 631 is connected between the power source line 606 and the gate electrode of the sixth transistor 616 and the seventh transistor 617. A first electrode of the fifth transistor 615 is connected to the first electrode of the thirteenth transistor 623 and a second electrode thereof is connected to the power source line 606 through the tenth transistor 620. A first electrode of the sixth transistor 616 is connected to the current source line 605 through the ninth transistor 619 and the second electrode thereof is connected to the power source line 606 through the eleventh transistor 621. A first electrode of the seventh transistor 617 is connected to the first electrode of the sixth transistor 616 and a second electrode thereof is connected to a second electrode of the fourth transistor 614 and also to the power source line 606 through the twelfth transistor 622. The gate electrode of the fourth transistor 614 and gate electrodes of the eighth transistor 618 to the thirteenth transistor 623 are each connected to the third scanning line 604.

The second transistor 612 for erasing is provided in a position to discharge electric charges of the capacitor element 630 or a position to block current supplied to the light emitting element 632. The position is not limited to the position shown in FIG. 14.

Further, the second transistor 612 for erasing may be arranged optionally. The second transistor 612 for erasing can be omitted, because the fourth transistor 614 for light emission have a function as the erasing transistor. In such case, however, a scanning line different from the third scanning line 604 needs to be provide in order to control the transistor also having function as the erasing transistor.

In the case that the second transistor is controlled so that the third transistor 613 is set to be in OFF state, the fourth transistor 614 is not required.

Next, operations for setting current and for light emission in the above pixel will be described.

A display screen has plural pixels, one of which is shown in FIG. 14, and the first scanning line 602 is sequentially selected. Then, the first transistor 611 connected to the selected first scanning line 602 is turned on, and a video signal is input from the signal line 601. Based on the input video signal, electric charges are stored in the first storage capacitor 630. When the amount of the stored electric charges exceeds Vgs of the third transistor 613, the third transistor 613 is turned on and can supply signal current to the light emitting element 632.

In response to the state where signal current can be supplied to the light emitting element, the fourth transistor 614 controlled by the third scanning line 604 is turned on. Then, signal current set by the current source circuit is supplied to the light emitting element 632. In other words, the first transistor 511, the second transistor 512 and the third transistor 513, which are connected in series as described in FIG. 6B, correspond to the fifth transistor 615, the sixth transistor 616 and the seventh transistor 617 in FIG. 14, respectively. Signal current is supplied to the light emitting element 632 through the fifth transistor 615 to the seventh transistor 617, which are connected in series.

The operation for setting signal current in the current source circuit is the same as the one described in FIG. 6A, and the description will be omitted here. It is noted that the first switch 521, the second switch 522, the third switch 523, the fourth switch 524, the sixth switch 526, the seventh switch 527 and the eighth switch 528 in FIG. 6A correspond to the eighth transistor 618, the twelfth transistor 622, the ninth transistor 619, the eleventh transistor 621, the third transistor 623, the eleventh transistor 621 and the tenth transistor 620 in FIG. 14, respectively.

As described above, according to the present invention, a driving element of a current source circuit includes plural transistors. Thus, a unit (the transistors according to this embodiment mode) can be used for connecting transistors in parallel during a setting operation for writing current and in series during light emission for causing a light emitting element to emit light. Then, the current value $I_W$ during the setting operation and the current value $I_E$ of current to be supplied to a light emitting element during the light emission can be set arbitrarily. Thus, even when the current $I_E$ is significantly small, the setting operation can be performed securely. Furthermore, the setting time can be reduced. In addition, variations in luminance of the light emitting element can be reduced according to the present invention.

Embodiment Mode 5

In this embodiment mode, a specific structure of a pixel provided with current source circuit in which current flows in emitting light as shown in FIG. 23C is described with reference to FIG. 15. FIGS. 23B and 23C are different in that the direction of current flow and the connections are different. However, the both are the same in essentials.

Figure 15:
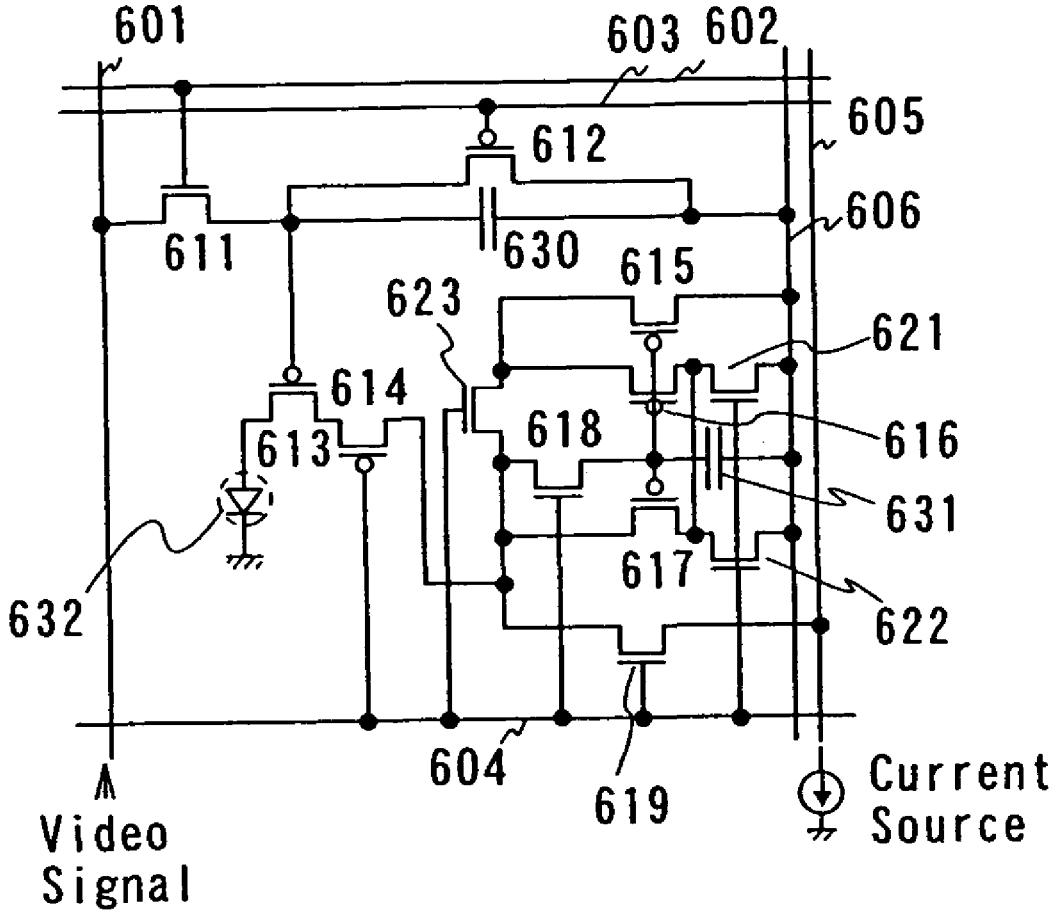
FIG. 15 is a circuit diagram of a pixel according to the present invention.

The pixel shown in FIG. 15 is an example of a pixel provided with a current circuit as shown in FIGS. 23A to 23C and is different from the pixel shown in FIG. 14 in that the second transistor is arranged to discharge electric charges of the first storage capacitor 630 and the second electrode of the sixth transistor 616 is connected to the second electrode of the seventh transistor 617. Further, the thirteenth transistor 623 is connected to the current source line 605 through the ninth transistor 619 and the first electrodes of the seventh transistor 617 and the eighth transistor 618 and the second electrode of the fourth transistor 614 is connected between the ninth transistor 619 and the third transistor 623.

The eighth transistor 618, the ninth transistor 619, the eleventh transistor 621, the twelfth transistor 622 and the thirteenth transistor 623 in FIG. 15 correspond to the first switch 521, the third switch 523, the fourth switch 524, the second switch 522 and the sixth switch 526 in FIG. 5B, respectively.

According to this embodiment mode, the erasing transistor may be provided arbitrarily and may be located anywhere as far as current does not flow into a light emitting element when the light emitting element needs to be shut off. For example, the second transistor 612 for erasing may be provided at a position for discharging electric charges in the first storage capacitor 630 or at a position for shutting off current to be supplied to the light emitting element 632 on a path that current flow. According to this embodiment mode, the current shut-off may be controlled by a transistor for erasing, or a transistor for erasing may be provided so that a driving transistor can control the current shut-off.

For the display in multi-level gray scale in Time Gray Scale Method in which one frame is divided by an arbitrary number, the second transistor 612 for erasing may be provided freely so as to provide an erasing time for stopping the light emission by a light emitting element at an arbitrary timing. Then, when a period that the light emitting element is emitting light (light-up time) is longer than an address time, the erasing transistor is not required. Thus, a transistor for erasing may be provided optionally. Therefore, the erasing transistor 612 may be also omitted in some cases. The address time, the erasing time, the light-up time will be described in Embodiment Mode 6.

The fourth transistor 614 is not required when the second transistor 612 and/or the third transistor 613 are controlled to be turned off in setting.

The first transistor 611 connected to the selected first scanning line 602 is turned on, and a video signal is input from the signal line 601. Based on the input video signal, electric charges are stored in the first storage capacitor 630. When the amount of the stored electric charges exceeds Vgs of the third transistor 613, the third transistor 613 is turned on and can supply signal current to the light emitting element 632.

In response to the state where signal current can be supplied to the light emitting element 632, the fourth transistor 614 controlled by the third scanning line 604 is turned on. Then, signal current set by the current source circuit is supplied to the light emitting element 632. In other words, the first transistor 511, the second transistor 512, and the third transistor 513, which are connected in series as described in FIG. 7B, correspond to the fifth transistor 615, the sixth transistor 616 and the seventh transistor 617 in FIG. 15. Signal current is supplied to the light emitting element 632 through the fifth transistor 615, the sixth transistor 616 and the seventh transistor 617, which are connected in series.

The operation for setting signal current in the current source circuit is the same as the one described in FIG. 7A, and the description will be omitted here.

As described above, according to the present invention, a driving element of a current source circuit includes plural transistors. Thus, a unit (the transistors according to this embodiment mode) can be used for connecting transistors in parallel during a setting operation for writing current and in series during light emission for causing a light emitting element to emit light. Then, the current value $I_W$ during the setting operation and the current value $I_E$ of current to be emitted to a light emitting element during the light emission can be set arbitrarily. Thus, even when the current $I_E$ is significantly small, the setting operation can be performed securely. Furthermore, the setting time can be reduced. In addition, variations in luminance of the light emitting element can be reduced according to the present invention.

In the above embodiment modes, the polarity of each transistor that constitute the current source transistors are p-type, which is only an example. The present invention is not limited thereto and an n-type transistor can be adopted.

Embodiment Mode 6

Figures 16A, 16B:
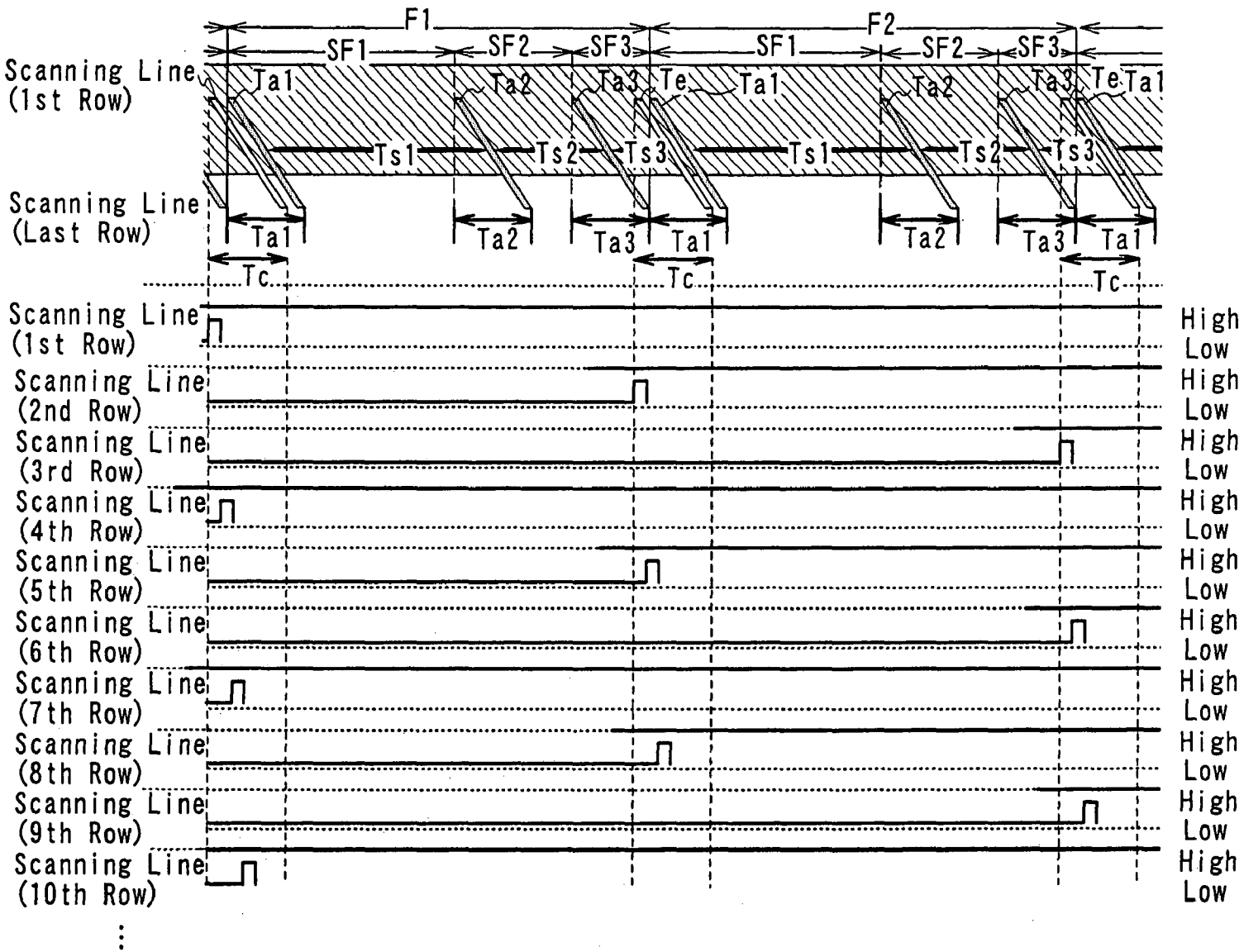
FIGS. 16A and 16B are timing charts of a pixel according to the present invention.

According to this embodiment mode, Time Gray Scale Method is used for the display in multi-level gray scale. FIGS. 16A and 16B show timing charts where the display in multi-level gray scale is performed in Time Gray Scale Method.

FIG. 16A shows frame periods F1 and F2. Each frame period is divided into three sub-frame periods SF1, SF2 and SF3 in the frame periods F1 and F2. Each of the sub-frame periods SF1, SF2 and SF3 has writing periods (also called address period) Ta1, Ta2 and Ta3 and light-up periods (also called light emitting period or display period) Ts1, Ts2 and Ts3. During each of the writing periods Ta1, Ta2 and Ta3, the first row to the last row of scanning lines are sequentially selected, and signal current is written into the selected pixels. During each of the light-up period Ts1, Ts2 and Ts3, a light emitting element is lighted up based on the written signal current.

The sub-frame period having a short light-up period overlaps with the next writing period, which is a problem. Therefore, a sub-frame period having a short light-up period (SF3 in FIG. 16) has an erasing period Te for forcibly terminating the light-up period. When the erasing period is provided, the second transistor 812 in the pixel shown in FIGS. 8A to 8C, 9-13, and FIGS. 24 to 27 and the second transistor 612 in the pixel shown in FIGS. 14 and 15 correspond to erasing transistors.

During the writing period, the light emitting operation shown in one of FIGS. 3B, 4B, 6B and 7B is performed in the pixel.

The operation for setting signal current is performed when a switch for controlling the connection between the light emitting element and the current source circuit is off (see FIGS. 3A, 4A, 6A and 7A). Thus, the operation for setting signal current must be performed in the erasing period Te. Therefore, a setting period Tc is provided in a period matching with the erasing period Te.

During the setting period, the operation shown in one of the FIGS. 3A, 4A, 6A and 7A is performed.

However, in reality, the completion of the setting operation for all pixel is difficult in the setting period. Therefore, the setting operation for pixels connected to one row of scanning line needs a certain period of time.

The speed for selecting each scanning line in the setting period is desirably the same as those of the writing period and/or the erasing period. Thus, even when the setting operation for pixels connected to one row of scanning line takes time, the scanning line ahead for the amount of taken time is selected. Therefore, the setting operation may be performed on pixels connected to the scanning lines at arbitrary intervals.

For example, as shown in FIG. 16B, the setting operation may be performed on the pixels connected to every two scanning lines. In FIG. 16B, the selected scanning lines are High and the other scanning lines are Low.

Then, the scanning line at the first row is selected in a setting period Tc, and the setting operation is performed by taking a time for selecting three rows of scanning lines (corresponding to the first row to the third row). Next, the scanning line at the fourth row is selected, and the setting operation is performed similarly by taking the time for selecting three rows of scanning lines. Subsequently, the setting operation is performed sequentially on the scanning lines at the seventh row, at the tenth row and so on. These setting operations are performed in one setting period.

In the next setting period, the scanning line at the second row is selected first, and the setting operation is performed by taking the time for selecting three rows of scanning lines (corresponding to the first to third rows). Next, the setting operations are performed sequentially on the scanning lines at the fifth row, at the eighth row and so on.

In the next setting period, the scanning line at the third row is selected first, and the setting operation is performed by taking the time for selecting three rows of scanning lines (corresponding to the first to third rows). Next, the setting operations are performed sequentially on the scanning lines at the sixth row, at the ninth row and so on.

When every two scanning lines are selected for the setting operations as shown in FIG. 16B, the setting operations on all pixels can be finished in three setting periods Tc.

Apparently, the interval of scanning lines may be set arbitrarily, and the interval of the scanning lines may be increased as the time required for the setting operation increases. Furthermore, the number of sub-frame periods may be set as necessary.

For faster setting operations, the number of transistors of the current source transistors of the current source circuit may be increased. As disclosed in Embodiment Mode 2 to Embodiment Mode 5, the current source transistors may include two or three transistors.

The period from the end of one setting operation to the next setting operation may be set arbitrarily. The next setting operation may be performed when electric charges stored in the capacitor element 821 decreases due to the leak or the like. The setting operation does not have to be always performed from the first scanning line.

When one frame has plural sub-frame periods, and when the light-up time is shorter than the address time, plural erasing times are required. Then, plural setting periods can be provided, and the setting operation can take more time.

As described above, setting operations can be performed by using the erasing times efficiently according to the driving method of this embodiment mode. Furthermore, since transistors are connected in parallel in setting operations, signal current can be set fast.

Embodiment Mode 7

Figure 17:
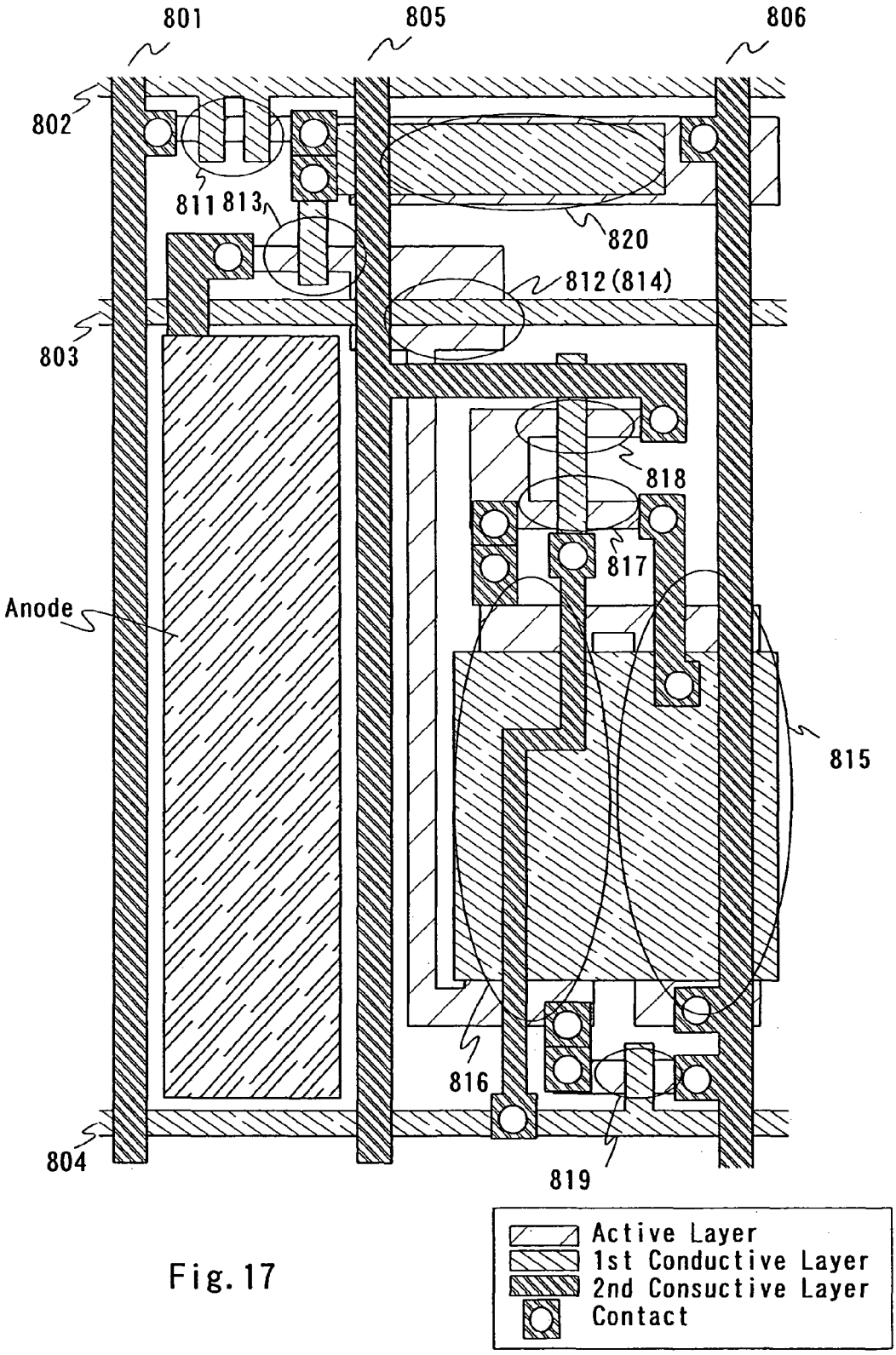
FIG. 17 is a top view of a pixel according to the present invention.
Figure 18:
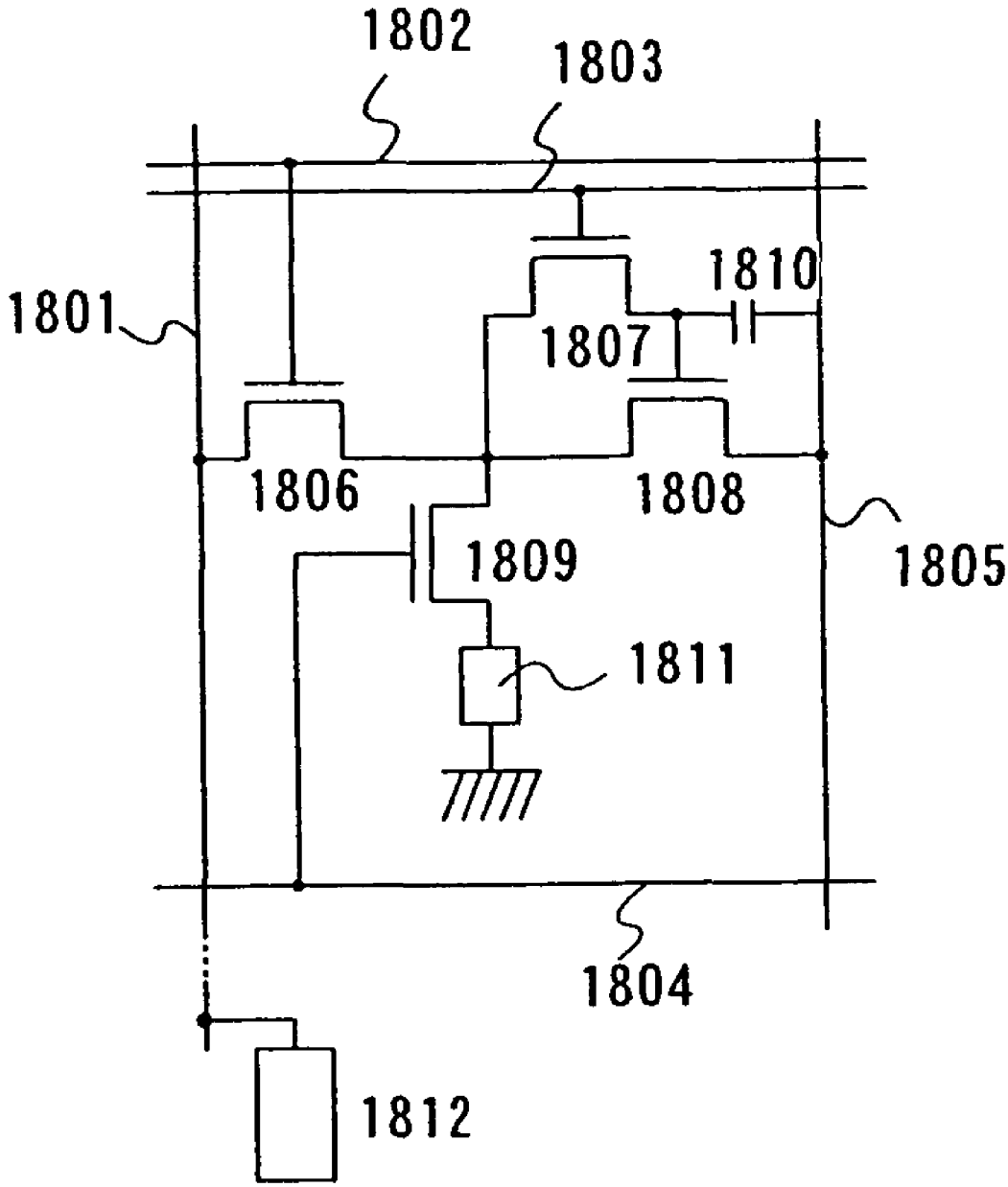
Fig. 18 PRIOR ART
FIG. 18 is a circuit diagram of a pixel.

According to this embodiment mode, each transistor in the pixel shown in FIGS. 8A to 8C is a thin film transistor (TFT, hereinafter). FIG. 17 shows a top view of the TFT according to this embodiment mode. The transistor may be produced by using a monocrystal, SOI, organic transistor or the like. In FIG. 17, the second capacitor element 821 is omitted, and the second transistor 812 for erasing is also used as the fourth transistor 814 for light emission.

Referring to FIG. 17, a same layer is patterned in a region for forming a TFT to obtain plural active layers. Next, a same layer is patterned to obtain the first scanning line 802, the second scanning line 803 and the third scanning line 804. After that, a same layer is patterned to obtain the signal line 801, the current source line 805 and the power source line 806. Finally, a first electrode (which is an anode, here) of a light emitting element is provided.

The first transistor 811 for selection is provided. The gate electrode of the first transistor 811 is a part of the first scanning line 802. The first transistor 811 has a double-gate structure having two gate electrodes on one active layer (semiconductor film). Thus, the selection (switching) can be performed more securely in the double-gate structure than in a single-gate structure having one gate electrode on one active layer. The first transistor 811 may have a multi-gate structure having three or more gate electrodes on one active layer.

The second transistor 812 for erasing (814) that also functions as a transistor for light emission is provided. The gate electrode of the second transistor 812 (814) is a part of the second scanning line 803. The third transistor 813 for driving is provided, and the gate electrode of the third transistor 813 is connected to the second electrode of the first transistor through a contact.

In order to reduce variations in the fifth transistor 815 and the sixth transistor 816 of the current source transistor, the channel length (L) and the channel width (W) of the channel forming region of the TFT are preferably increased. Furthermore, laser is preferably irradiated in one direction for the crystallization of the active layers. Furthermore, by increasing the L and W of the channel forming region, the gate capacitance is increased. Therefore, the second capacitor element 821 can be omitted.

Furthermore, the seventh transistor 817, the eighth transistor 818 and the ninth transistor 819 are provided. The gate electrodes of the seventh transistor 817, the eighth transistor 818 and the ninth transistor 819 are connected to the third scanning line 804. The first electrode of the seventh transistor 817 is connected to the gate electrodes of the fifth transistor and the sixth transistor. The first storage capacitor 820 is provided, and the first storage capacitor 820 includes the active layer and the same layer as that of the scanning lines.

The structure of each of these TFTs may have a top-gate type structure in which the gate electrode is provided on the channel forming region or may have the opposite bottom-gate type structure. An offset structure and/or GOLD structure may be used for impurity regions (source region or drain region).

Embodiment Mode 8

The following are examples of electronic appliances having a pixel portion provided with a light emitting element formed according to the present invention: video cameras, digital cameras, goggle type displays (head mounted displays), navigation systems, audio players (car audios, audio components, etc.), notebook type personal computers, game machines, portable information terminals (mobile computers, mobile telephones, mobile type game machines, electronic books, etc.), image players equipped with a recording medium (specifically, devices equipped with displays each of which is capable of playing a recording medium such as a digital versatile disk (DVD). and displaying the image thereof), and the like. In particular, as for a portable information terminal whose screen is often viewed from a diagonal direction, since a wide angle of view is regarded as important, it is desirable that a display device with a light emitting element be used. Specific examples of these electronic appliances are shown in FIGS. 19A to 19H.

Figure 19A:
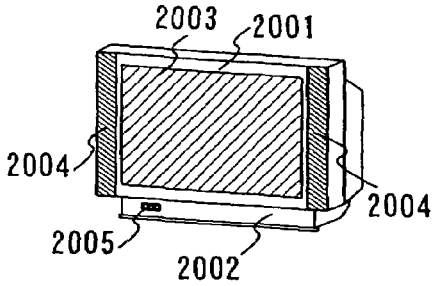
FIGS. 19A to 19H show electronic appliances using a pixel according to the present invention.

FIG. 19A shows a display device, which includes a casing 2001, a support base 2002, a display portion 2003, a speaker portion 2004, a video input terminal 2005 and the like. A pixel portion provided with a light emitting element formed according to the present invention may be applied to the display portion 2003. Note that all light emitting devices for displaying information including light emitting devices for personal computers, those for receiving TV broadcasting, those for displaying advertising, and the like are also included in the display device.

Figure 19B:
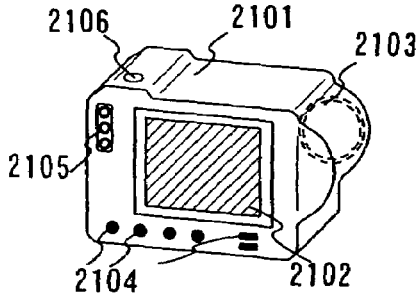

FIG. 19B shows a digital still camera, which includes a main body 2101, a display portion 2102, an image-receiving portion 2103, operation keys 2104, an external connection port 2105, a shutter 2106 and the like. A pixel portion provided with a light emitting element formed according to the present invention may be applied to the display portion 2102.

Figure 19C:
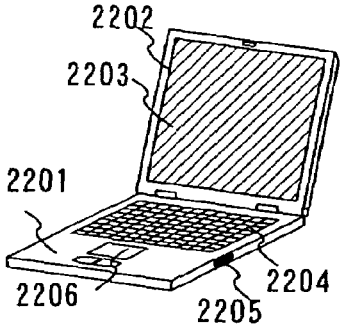

FIG. 19C shows a notebook type personal computer, which includes a main body 2201, a casing 2202, a display portion 2203, a keyboard 2204, external connection ports 2205, a pointing mouse 2206, and the like. A pixel portion provided with a light emitting element formed according to the present invention may be applied to the display portion 2203.

Figure 19D:
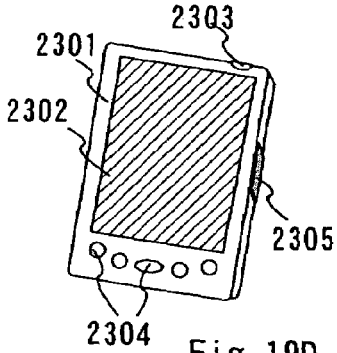

FIG. 19D shows a mobile computer, which includes a main body 2301, a display portion 2302, switches 2303, operation keys 2304, an infrared port 2305, and the like. A pixel portion provided with a light emitting element formed according to the present invention may be applied to the display portion 2302.

Figure 19E:
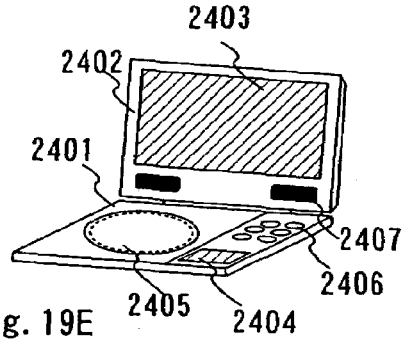

FIG. 19E shows a portable image player provided with a recording medium (specifically, a DVD player), which includes a main body 2401, a casing 2402, a display portion A 2403, a display portion B 2404, a recording medium (such as a DVD) read-in portion 2405, operation keys 2406, a speaker portion 2407, and the like. A pixel portion provided with a light emitting element formed according to the present invention can be used in both the display portion A 2403 and in the display portion B 2404 while the display portion A 2403 mainly displays image information, and the display portion B 2404 mainly displays character information. Note that image players provided with a recording medium include game machines for domestic use.

Figure 19F:
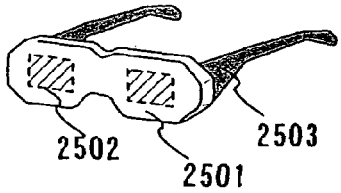

FIG. 19F shows a goggle type display (head mounted display), which includes a main body 2501, a display portion 2502, an arm portion 2503, and the like. The present invention can be used in the display portion 2502. A pixel portion provided with a light emitting element formed according to the present invention can be used in the display portion.

Figure 19G:
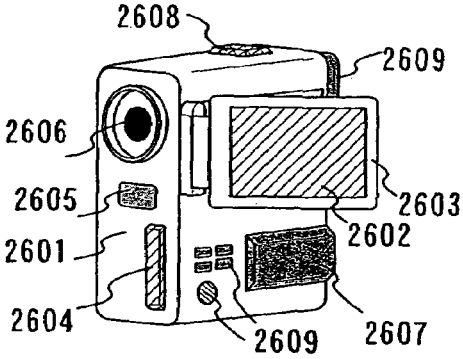

FIG. 19G shows a video camera, which includes a main body 2601, a display portion 2602, a casing 2603, external connection ports 2604, a remote-controlled receiving portion 2605, an image receiving portion 2606, a battery 2607, an audio input portion 2608, operation keys 2609, an eye piece 2610, and the like. A pixel portion provided with a light emitting element formed according to the present invention may be applied to the display portion 2602.

Figure 19H:
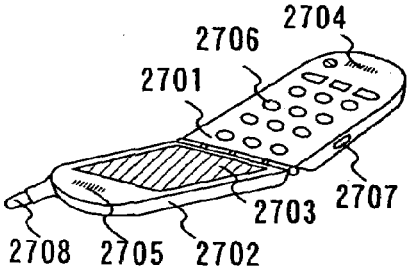

Here, FIG. 19H shows a mobile telephone, which includes a main body 2701, a casing 2702, a display portion 2703, an audio input portion 2704, an audio output portion 2705, operation keys 2706, external connection ports 2707, an antenna 2708, and the like. A pixel portion provided with a light emitting element formed according to the present invention may be applied to the display portion 2703. Note that by displaying white characters on a black background in the display portion 2703, the power consumption of the mobile telephone can be reduced.

As described above, the present invention can be widely applied to and used in electronic appliances in various fields. Further, the electronic appliances of this embodiment mode may employ any one of the pixel structures of Embodiment Modes 1 to 7.

Embodiment Mode 9

The electronic appliances shown in Embodiment Mode 8 have a module, mounting an IC including a controller, a power source circuit and the like, mounted on a panel in a state sealed with the light emitting elements. Both the module and the panel correspond to one mode of a display device. Here, explanation is made on a concrete configuration of the module.

Figure 20A:
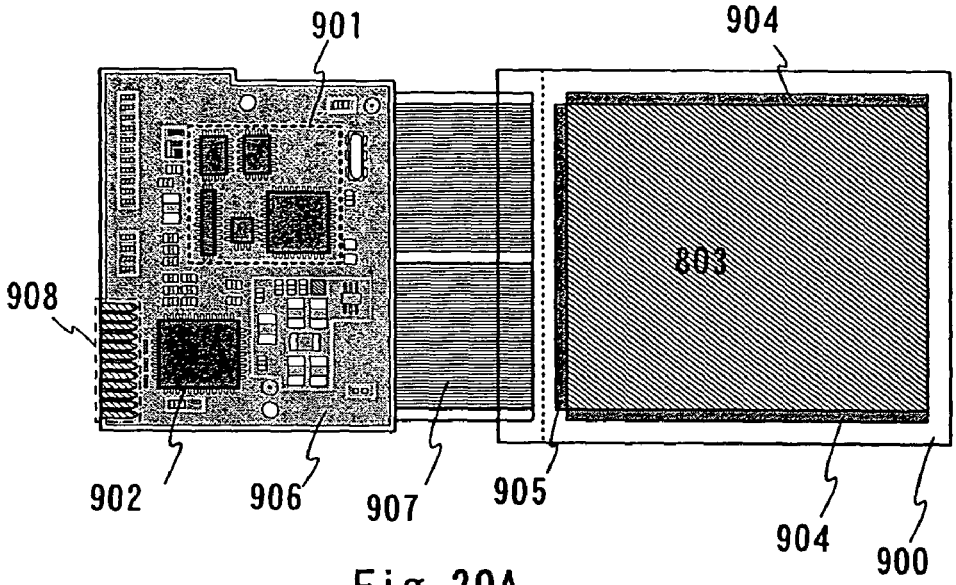
FIGS. 20A and 20B show a module using a pixel according to the present invention.

FIG. 20A shows an outline view of a module having a controller 901 and a power source circuit 902 mounted on a panel 900. The panel 900 is provided with a pixel portion 903 having light emitting elements on respective pixels, a scanning line driver circuit 904 for selecting a pixel possessed by the pixel portion 903, and a signal line driver circuit 905 for supplying a video signal to the selected pixel.

Meanwhile, a printed board 906 is provided with the controller 901 and the power source circuit 902. The various signals and power source voltage outputted from the controller 901 or the power source circuit 902 are supplied to the pixel portion 903, the scanning line driver circuit 904 and the signal line driver circuit 905 in the panel 900 through an FPC 907.

The various signals and power source voltage to the printed board 906 are supplied through an interface (I/F) section 908 arranged with a plurality of input terminals.

Incidentally, although, in this embodiment mode, the printed board 906 is mounted on the panel 900 by the use of the FPC, the present invention is not limited to this structure. The COG (chip on glass) method may be used to directly mount the controller 901 and the power source circuit 902 on the panel 900.

Also, on the printed board 906, there is a case that noise may be involved in the power source voltage or signal, or the signal rise may be blunted, due to the capacitances formed between the lead wirings and the resistances possessed by the wirings themselves. Consequently, various elements such as capacitors and buffers may be provided on the printed board 806, to prevent noise from being involved in the power source voltage or signal or to prevent signal rise from being blunted.

Figure 20B:
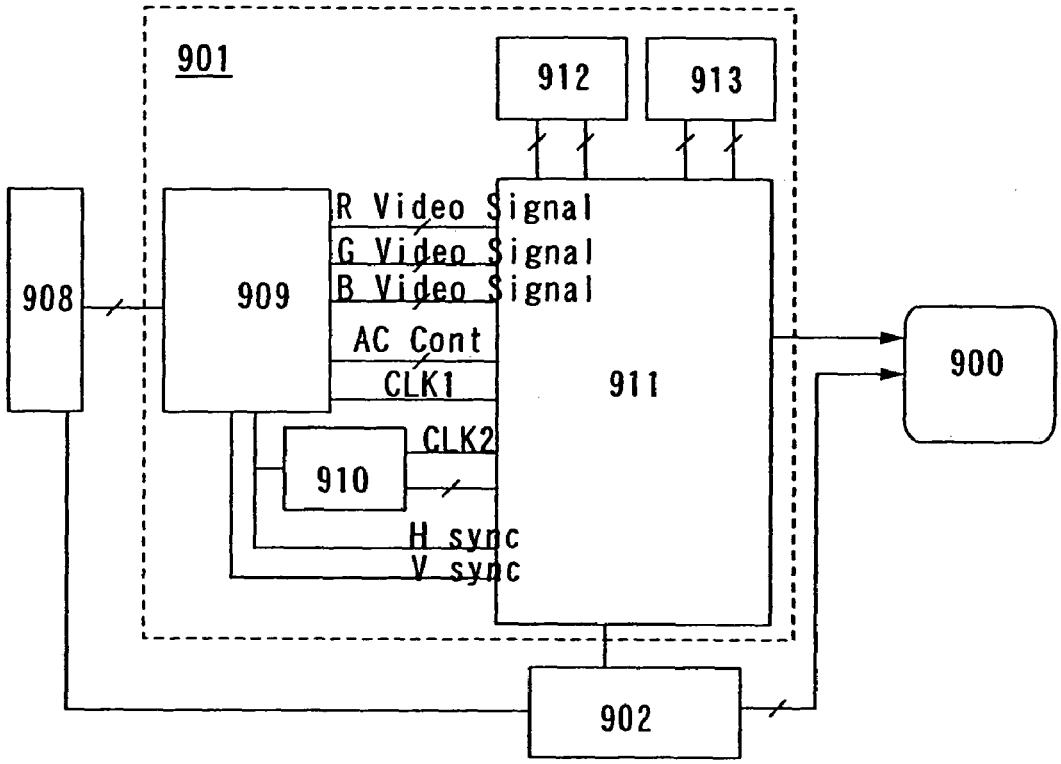

FIG. 20B is a block diagram showing a structure of the printed board 906. The various signals and power source voltage supplied to the interface 908 are then supplied to the controller 901 and the power source circuit 902.

The controller 901 has a phase-locked loop (PLL) 910, a control-signal generating circuit 911; if necessary, an A/D converter 909, SRAMs (static random access memories) 912, 913. The provision of the A/D converter and the SRAMS depend on whether signals to be inputted are analog signals or digital signals, or the case where a pixel structure of a panel is controlled by either of analog signals or digital signals. Besides, an SRAM is provided in the case of performing digital drive. Note that, instead of the SRAM, an SDRAM may also be used, or a DRAM (dynamic random access memory) may also be used as long as writing and reading of data can be performed at high speed.

The video signals supplied through the interface 908 are subjected to parallel-serial conversion in the A/D converter 909, and the resultant signals, which serve as the video signals corresponding to the respective colors of R, Q and B, are inputted to the control signal generating portion 911. Further, an Hsync signal, Vsync signal, clock signal CLK, and an alternating voltage (AC Cont) are generated in the A/D converter 909 based on the respective signals supplied through the interface 908, and are inputted to the control signal generating portion 911.

The phase-locked loop 910 has a function to synchronize the phase of the frequency of various signals supplied through the interface 908 with the phase of the operating frequency of the control-signal generating circuit 911. The operating frequency of the control-signal generating circuit 911 is not necessarily the same as the frequency of the various signals supplied through the interface 908, but adjust, in the phase-locked loop 910, the operating frequency of the control-signal generating circuit 911 in a manner of synchronization with one another.

The video signal inputted to the control-signal generating circuit 911 is once written into and held on the SRAM 912, 913. The control-signal generating circuit 911 reads out, bit by bit, the video signals corresponding to all the pixels from among all the bits of video signals held on the SRAM 912, and supplies them to the signal line driver circuit 905 in the panel 900.

The control-signal generating portion 911 supplies the information concerning a period during which the light emitting element of each bit causes light emission, to the scanning line driver circuit 904 in the panel 900.

The power source circuit 902 supplies a predetermined power source voltage to the signal line driver circuit 905, the scanning line driver circuit 904 and the pixel portion 903 in the panel.

Next, a structure of the power source circuit 902 is described in detail with reference to FIG. 21. The power source circuit 902 comprises a switching regulator 954 using four switching regulator controls 960 and a series regulator 955.

Generally, the switching regulator, small in size and light in weight as compared to the series regulator, can raise voltage and invert polarities besides voltage reduction. On the other hand, the series regulator, used only in voltage reduction, has a well output voltage accuracy as compared to the switching regulator, hardly causing ripples or noises. The power source circuit 902 of this embodiment mode uses a combination of the both.

Figure 21:
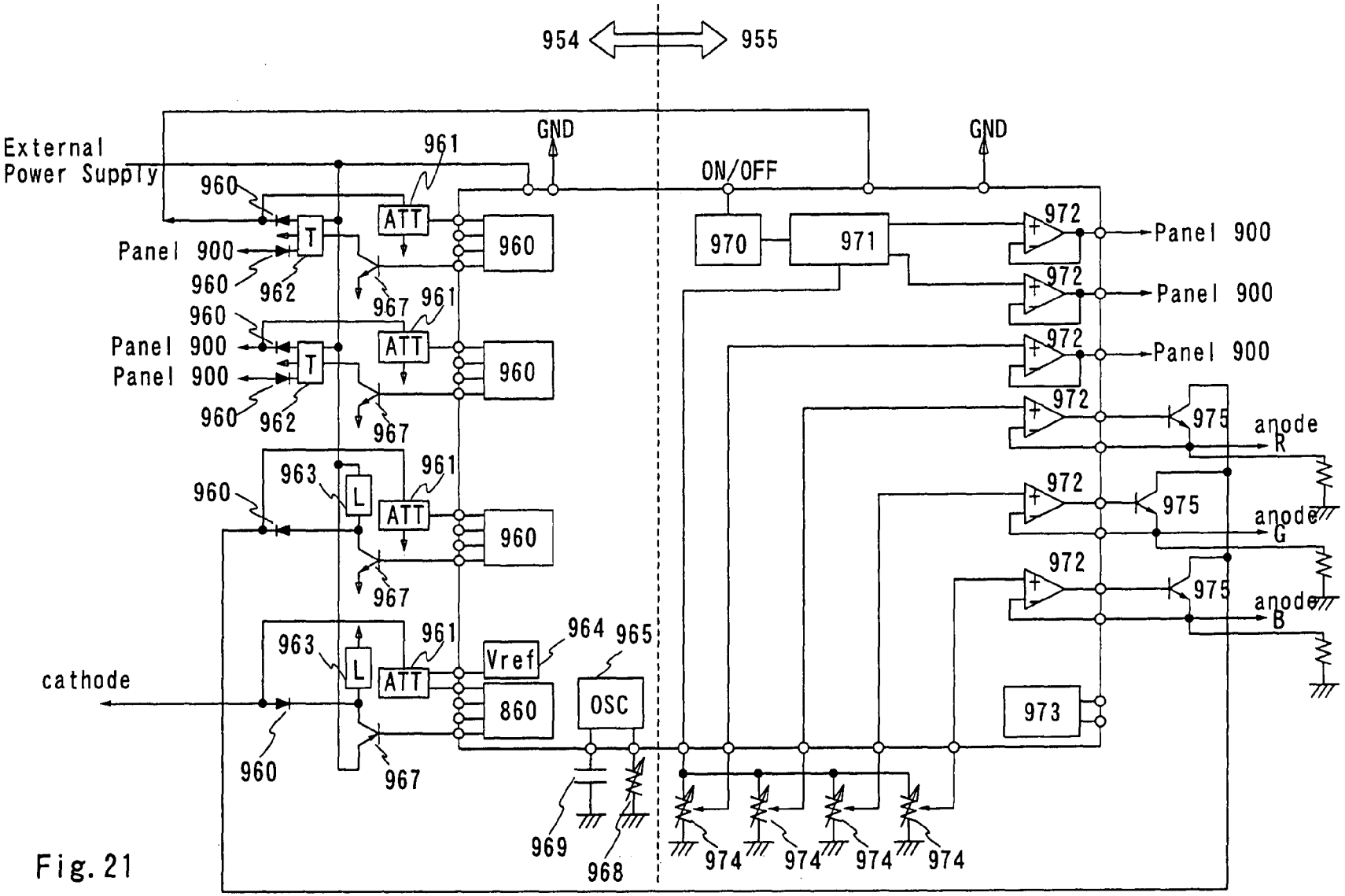
FIG. 21 shows a power source circuit diagram of a module using a pixel according to the present invention.

The switching regulator 954 shown in FIG. 21 has a switching regulator control (SWR) 960, an attenuator (ATT) 961, a transformer (T) 962, an inductor (L) 963, a reference power source (Vref) 964, an oscillator circuit (OSC) 965, a diode 966, a bipolar transistor 967, a varistor 968 and a capacitance 969.

When a voltage of an external Li ion battery (3.6 V) or the like is transformed in the switching regulator 954, generated are a power source voltage to be supplied to a cathode and a power source voltage to be supplied to the switching regulator 854.

The series regulator 955 has a band-gap circuit (BG) 970, an amplifier 971, operational amplifiers 972, a current source 973, a varistor 974 and a bipolar transistor 975, and is supplied with the power source voltage generated at the switching regulator 954.

In the series regulator 955, the power source voltage generated by the switching regulator 954 is used to generate a direct current power source voltage to be supplied to a wiring (current supply line) for supplying current to the anodes of various-color of light emitting elements depending upon a constant voltage generated by the band-gap circuit 970.

Incidentally, the current source 973 is used for a driving method to write video signal current to the pixel. In this case, the current generated by the current source 973 is supplied to the signal line driver circuit 905 in the panel 900. In the case of a driving method to write the video signal voltage to the pixel, the current source 973 is not necessarily provided.

Note that the switching regulator, OSC, amplifier, and operational amplifier can be formed by using the above described manufacturing method.

therefore, in a current source circuit having plural transistors as a driving element, the connection of the plural transistors may be switched between parallel connection and serial connection in accordance with the current writing and the light emission by a light emitting element, respectively.

Thus, the current value $I_W$ at the setting time and the current value $I_E$ supplied to a light emitting element during the light emission may be set arbitrarily. Therefore, even when $I_E$ is significantly small, the setting operation can be performed securely. Furthermore, the setting time can be reduced. According to the present invention, variations in luminance of a light emitting element can be reduced by accurately setting a signal current.

What is claimed:

1. A current source circuit comprising:

a first transistor and a second transistor;

a capacitor element connected to the gate electrodes of the first transistor and the second transistor;

a power source line connected to one end of the capacitor element;

a current source line connected to the other end of the capacitor element; and means for supplying electric charges held in the capacitor element to the gate electrodes of the first transistor and the second transistor to be driven, wherein the first and second transistors are connected in a parallel connection state when storing electric charges in the capacitor element.

2. The current source circuit according to claim 1, wherein the first transistor and second transistor are p-channel type thin film transistors.

3. The current source circuit according to claim 1, wherein the first transistor and second transistor are singlecrystalline, SOI or organic transistors.

4. A current source circuit comprising:

a first transistor, a second transistor and a third transistor;

a capacitor element connected to the gate electrodes of the first transistor, the second transistor and the third transistor;

a power source line connected to one end of the capacitor element;

a current source line connected to the other end of the capacitor element; and means for supplying electric charges held in the capacitor element to the gate electrodes of the first transistor and the second transistor to be driven.

5. The current source circuit according to claim 4, wherein the first transistor, second transistor and third transistor are p-channel type thin film transistors.

6. The current source circuit according to claim 4, wherein the first transistor, second transistor and third transistor are singlecrystalline, SOI or organic transistors.

7. A method for driving a current source circuit having a first transistor, a second transistor, a capacitor element connected to the gate electrodes of the first transistor and the second transistor, a current source line and a power source line connected to the capacitor element, the method comprising the steps of:

feeding current supplied from the power source line to the current source line through the first transistor and second transistor, which are connected in parallel with each other; and feeding current from the power source line to an object to be driven through the first transistor and second transistor, which are connected in series with each other.

8. The method for driving a current source circuit according to claim 7, further having:

plural scanning lines;

plural signal lines to which digital signals are input;

light emitting elements provided at the intersection positions of the scanning lines and the signal lines; and a current source circuit for supplying current to the light emitting elements, the method further comprising the steps of:

dividing a unit frame period corresponding to an synchronizing timing of video signals input to the signal line into m sub frame periods, SF1, SF2 . . . and SFm (where m is a natural number of two or larger) and providing at least one of them sub-frame periods SF1, SF2 . . . and SFm with an erasing time; and performing a setting operation on the current source circuit in the erasing time.

9. A method for driving a current source circuit having a first transistor, a second transistor, a capacitor element connected to the gate electrodes of the first transistor and the second transistor, a current source line and a power source line connected to the capacitor element, the method comprising the steps of:

connecting the first transistor and second transistor in parallel with each other when a setting operation is performed on the first transistor and second transistor; and connecting the first transistor and second transistor in series with each other when current is supplied from the first transistor and second transistor to an object to be driven.

10. The method for driving a current source circuit according to claim 9, further having:

plural scanning lines;

plural signal lines to which digital signals are input;

light emitting elements provided at the intersection positions of the scanning lines and the signal lines; and a current source circuit for supplying current to the light emitting elements, the method further comprising the steps of:

dividing a unit frame period corresponding to an synchronizing timing of video signals input to the signal line into m sub frame periods, SF1, SF2 . . . and SFm (where m is a natural number of two or larger) and providing at least one of the m sub-frame periods SF1, SF2 . . . and SFm with an erasing time; and performing a setting operation on the current source circuit in the erasing time.

11. A method for driving a current source circuit having a first transistor, a second transistor, a capacitor element connected to the gate electrodes of the first transistor and the second transistor, a current source line and a power source line connected to the capacitor element, the method comprising the steps of:

feeding current to the capacitor element and holding electric charges such that the capacitor element can feed a predetermined amount of voltage;

supplying current based on the predetermined amount of voltage to the first transistor and second transistor, which are connected in parallel with each other, such that the transistors can feed a predetermined amount of current; and supplying the predetermined amount of current to an object to be driven through the first transistor and second transistor, which are connected in series with each other.

12. The method for driving a current source circuit according to claim 11, further having:

plural scanning lines;

plural signal lines to which digital signals are input;

light emitting elements provided at the intersection positions of the scanning lines and the signal lines; and a current source circuit for supplying current to the light emitting elements, the method further comprising the steps of:

dividing a unit frame period corresponding to an synchronizing timing of video signals input to the signal line into m sub frame periods, SF1, SF2 . . . and SFm (where m is a natural number of two or larger) and providing at least one of the m sub-frame periods SF1, SF2 . . . and SFm with an erasing time; and performing a setting operation on the current source circuit in the erasing time.

13. A method for operating a display device including a current source circuit having a first transistor, a second transistor, a capacitor element connected to the gate electrodes of the first transistor and the second transistor, a current source line and a power source line connected to the capacitor element, and a light emitting element connected to one electrode of the second transistor, the method comprising the steps of:

feeding current to the capacitor element and holding electric charges such that the capacitor element can feed a predetermined amount of voltage;

supplying current based on the predetermined amount of voltage to the first transistor and second transistor, which are connected in parallel with each other, such that the transistor can feed a predetermined amount of current; and supplying the predetermined amount of current to the light emitting element through the first transistor and second transistor, which are connected in series with each other.

14. The method for operating a display device according to claim 13, further including:

plural scanning lines;

plural signal lines to which digital signals are input;

light emitting elements provided at the intersection positions of the scanning lines and the signal lines; and a current source circuit for supplying current to the light emitting elements, the method further comprising the steps of dividing a unit frame period corresponding to an synchronizing timing of video signals input to the signal line into m sub frame periods, SF1, SF2 . . . and SFm (where m is a natural number of two or larger) and providing at least one of them sub-frame periods SF1, SF2 . . . and SFm with an erasing time; and performing a setting operation on the current source circuit in the erasing time.

15. A current source circuit comprising:

a first transistor and a second transistor;

a capacitor element connected to the gate electrodes of the first transistor and the second transistor;

a power source line connected to one end of the capacitor element;

a current source line connected to the other end of the capacitor element; and means for supplying electric charges held in the capacitor element to the gate electrodes of the first transistor and the second transistor to be driven, wherein one end of the capacitor element is connected to both the gate electrodes of the first and second transistors, wherein the first and second transistors are connected in a parallel connection state when storing electric charges in the capacitor element.

16. The current source circuit according to claim 15, wherein the first and second transistors are p-channel type thin film transistors.

17. The current source circuit according to claim 15, wherein the first and second transistors are singlecrystalline, SOI, organic or inorganic transistors.

18. A current source circuit comprising:

a first transistor, a second transistor, and a third transistor;

a capacitor element connected to the gate electrodes of the first transistor, the second transistor and the third transistor;

a power source line connected to one end of the capacitor element;

a current source line connected to the other end of the capacitor element; and means for supplying electric charges held in the capacitor element to the gate electrodes of the first transistor and the second transistor to be driven, wherein one end of the capacitor element is connected to the gate electrodes of the first, second, and third transistors.

19. The current source circuit according to claim 18, wherein the first, second, and third transistors are p-channel type thin film transistors.

20. The current source circuit according to claim 18, wherein the first, second, and third transistors are singlecrystalline, SOI, organic or inorganic transistors.

21. A current source circuit comprising:

a first transistor and a second transistor;

a capacitor element connected to the gate electrodes of the first transistor and second transistors;

a power source line connected to one end of the capacitor clement; and a current source line connected to the other end of the capacitor element, wherein the first and second transistors are connected in parallel with each other when the capacitor element is connected to the power source line and the current source line, while the first and second transistors are connected in series with each other when a current is supplied to an element to be driven.

22. The current source circuit according to claim 21, wherein the first and second transistors are p-channel type thin film transistors.

23. The current source circuit according to claim 21, wherein the first and second transistors are singlecrystalline, SOI, organic or inorganic transistors.

24. The current source circuit according to claim 21, wherein one end of the capacitor element is connected to both the gate electrodes of the first and second transistors.

25. A current source circuit comprising:

a first transistor, a second transistor, and a third transistor;

a capacitor element connected to the gate electrodes of the first, second, and third transistors;

a power source line connected to one end of the capacitor element; and a current source line connected to the other end of the capacitor element, wherein the first and second transistors are connected in parallel with each other when the capacitor element is connected to the power source line and the current source line, while the first and second transistors are connected in series with each other when a current is supplied to an element to be driven.

26. The current source circuit according to claim 25, wherein the first, second, and third transistors are p-channel type thin film transistors.

27. The current source circuit according to claim 25, wherein the first, second, and third transistors are single-crystalline, SOI, organic or inorganic transistors.

28. The current source circuit according to claim 25, wherein one end of the capacitor element is connected to both the gate electrodes of the first, second, and third transistors.

* * * * *